US012522904B2

(12) United States Patent
Tomio et al.

(10) Patent No.: US 12,522,904 B2
(45) Date of Patent: Jan. 13, 2026

(54) MARTENSITIC STAINLESS STEEL MATERIAL AND METHOD FOR PRODUCING MARTENSITIC STAINLESS STEEL MATERIAL

(71) Applicant: NIPPON STEEL CORPORATION, Tokyo (JP)

(72) Inventors: Yusaku Tomio, Tokyo (JP); Daisuke Matsuo, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 583 days.

(21) Appl. No.: 17/907,304

(22) PCT Filed: Apr. 13, 2021

(86) PCT No.: PCT/JP2021/015263
§ 371 (c)(1),
(2) Date: Sep. 26, 2022

(87) PCT Pub. No.: WO2021/210564
PCT Pub. Date: Oct. 21, 2021

(65) Prior Publication Data

US 2023/0109773 A1 Apr. 13, 2023

(30) Foreign Application Priority Data

Apr. 13, 2020 (JP) ..... 2020-071454

(51) Int. Cl.

| | |
|---|---|
| ***C22C 38/58*** | (2006.01) |
| ***C21D 9/08*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/52*** | (2006.01) |

(52) U.S. Cl.
CPC ..... *C22C 38/58* (2013.01); *C21D 9/085* (2013.01); *C22C 38/001* (2013.01); *C22C 38/02* (2013.01); *C22C 38/06* (2013.01); *C22C 38/42* (2013.01); *C22C 38/44* (2013.01); *C22C 38/52* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 2006/0174979 | A1 | 8/2006 | Kondo et al. | |
| 2015/0191809 | A1 | 7/2015 | Hashizume et al. | |
| 2015/0354022 | A1* | 12/2015 | Eguchi | C21D 6/008 148/592 |
| 2021/0317556 | A1* | 10/2021 | Kanki | C22C 38/42 |

FOREIGN PATENT DOCUMENTS

| | | | |
|---|---|---|---|
| JP | 2001098348 | A | 4/2001 |
| JP | 2012136742 | A | 7/2012 |
| JP | 2014043595 | A | 3/2014 |
| WO | 2005007915 | A1 | 1/2005 |

OTHER PUBLICATIONS

Quantitative electron microscopy and physically based modelling of Cu precipitation in precipitation-hardening martensitic stainless steel 15-5PH Tao Zhou (Year: 2018).*

* cited by examiner

*Primary Examiner* — Jenny R Wu
(74) *Attorney, Agent, or Firm* — Greer, Burns & Crain, Ltd.

(57) ABSTRACT

The martensitic stainless steel material according to the present disclosure consists of C: less than 0.030%, Si: 1.00% or less, Mn: 0.05 to 2.00%, Cr: 11.50 to 14.00%, Ni: 5.00 to 7.50%, Mo: 1.10 to 3.50%, Cu: 0.50 to 3.50%, Co: 0.01 to 0.30%, Al: 0.001 to 0.100%, N: 0.001 to 0.100%, and the balance: Fe and impurities. The microstructure is composed of retained austenite in an amount of 0 to 15 vol %, and ferrite in an amount of 0 to 10 vol %, with the balance being martensite. The yield strength is 862 MPa or more, and a number density of Cu precipitates is $3.0\times10^{21}$ to $50.0\times10^{21}/m^3$.

2 Claims, No Drawings

MARTENSITIC STAINLESS STEEL MATERIAL AND METHOD FOR PRODUCING MARTENSITIC STAINLESS STEEL MATERIAL

TECHNICAL FIELD

The present disclosure relates to a steel material and a method for producing a steel material, and more particularly relates to a martensitic stainless steel material having a microstructure mainly composed of martensite and a method for producing the martensitic stainless steel material.

BACKGROUND ART

Oil wells or gas wells (hereinafter, oil wells and gas wells are collectively referred to simply as "oil wells") may have been turned into a corrosive environment containing a corrosive gas. Here, the corrosive gas means carbon dioxide gas and/or hydrogen sulfide gas. Steel materials for use in oil wells are required to have excellent corrosion resistance in a corrosive environment.

It is known that chromium (Cr) is effective for improving the corrosion resistance of a steel material in a corrosive environment. Therefore, in corrosive environments, martensitic stainless steel materials containing about 13 mass % of Cr, typified by API L80 13Cr steel material (normal 13Cr steel material) and Super 13Cr steel material in which the C content is reduced, are used.

In addition, in recent years, due to the deepening of oil wells, there is a need for steel materials to have not just corrosion resistance but to also have higher strength. For example, demand begins to rise for steel materials of 110 ksi grade (110 to less than 125 ksi, that is, 758 to less than 862 MPa) and steel materials of 125 ksi grade or more (that is, 862 MPa or more).

Japanese Patent Application Publication No. 2001-98348 (Patent Literature 1), International Application Publication No. WO2005/007915 (Patent Literature 2), Japanese Patent Application Publication No. 2012-136742 (Patent Literature 3), and Japanese Patent Application Publication No. 2014-43595 (Patent Literature 4) each propose a steel material that has high strength and excellent corrosion resistance.

The steel material disclosed in Patent Literature I is a martensitic stainless steel pipe, and has a chemical composition consisting of, in mass %, C: 0.03% or less, N: 0.03% or less, Si: 0.70% or less, Mn: 0.30 to 2.00%, P: 0.03% or less, S: 0.005% or less, Cr: 10.5 to 15.0%, Ni: 7.0% or less, Al: 0.05% or less. Nb: 0.20% or less, V: 0.20% or less, and O: 0.01% or less under a condition of satisfying Formula (1) ($C+N \leq 0.04$), Formula (2) ($0.01 \leq 0.8Nb+0.5V \leq 0.20$), Formula (3) ($Cr+Mo+16N+0.5Ni-5C \geq 11.5$), and Formula (4) ($1.1(Cr+1.5Si+Mo)-Ni-0.5(Mn+Cu)-30(C+N) \leq 11$), with the balance being Fe and impurities. Patent Literature 1 discloses that this steel material has excellent corrosion resistance and high strength, and is excellent in weldability.

The steel material disclosed in Patent Literature 2 is martensitic stainless steel, and has a chemical composition consisting of, in mass %, C: 0.001 to 0.1%, Si: 0.05 to 1.0%, Mn: 0.05 to 2.0%, P: 0.025% or less, S: 0.010% or less, Cr: 11 to 18%, Ni: 1.5 to 10%, sol. Al: 0.001 to 0.1%, N: 0.1% or less, O: 0.01% or less, Cu: 0 to 5%, amount of dissolved Mo: 3.5 to 7%, W: 0 to 5%, V: 0 to 0.50%, Nb: 0 to 0.50%, Ti: 0 to 0.50%, Zr: 0 to 0.50%, Ca: 0 to 0.05%, Mg: 0 to 0.05%, REM: 0 to 0.05%, and B: 0 to 0.01%, and satisfying Formula (1) ($Ni\text{-bal.}=30(C+N)+0.5(Mn+Cu)+Ni+8.2-1.1(Cr+Mo+1.5Si) \geq -4.5$), with the balance being Fe, undissolved Mo if present, and impurities. Patent Literature 2 discloses that this steel material has high strength and is excellent in corrosion resistance.

The steel material disclosed in Patent Literature 3 is a high-strength martensitic stainless seamless steel pipe for oil wells, that has a chemical composition consisting of, in mass %, C: 0.01% or less, Si: 0.5% or less. Mn: 0.1 to 2.0%, P: 0.03% or less, S: 0.005% or less, Cr: 14.0 to 15.5%, Ni: 5.5 to 7.0%, Mo: 2.0 to 3.5%, Cu: 0.3 to 3.5%. V: 0.20% or less, Al: 0.05% or less, and N: 0.06% or less, with the balance being Fe and impurities, and that has a yield strength of 655 to 862 MPa and a yield ratio of 0.90 or more. Patent Literature 3 discloses that this steel material has high strength and stably excellent corrosion resistance.

The steel material disclosed in Patent Literature 4 is a martensitic stainless steel with high strength, high toughness and high corrosion resistance having a chemical composition consisting of, in mass %, C: 0.005 to 0.05%, Si: 1.0% or less, Mn: 2.0% or less, Cr: 16 to 18%, Ni: 2.5 to 6.5%, Mo: 1.5 to 3.5%, W: 3.5% or less, Cu: 3.5% or less, V: 0.01 to 0.08%, sol. Al: 0.005 to 0.10%, N: 0.05% or less, and Ta: 0.01 to 0.06%, with the balance being Fe and impurities. Patent Literature 4 discloses that this steel material has a yield strength of 758 to 965 MPa, excellent low-temperature toughness and excellent corrosion resistance.

CITATION LIST

Patent Literature

Patent Literature 1: Japanese Patent Application Publication No. 2001-98348

Patent Literature 2: International Application Publication No. WO2005/007915

Patent Literature 3: Japanese Patent Application Publication No. 2012-136742

Patent Literature 4: Japanese Patent Application Publication No. 2014-43595

SUMMARY OF INVENTION

Technical Problem

In this connection, oil wells are being made increasingly deeper in recent years. In particular, as a steel material for oil wells for which use in a region such as the North Sea, the Arctic Ocean coast, or Siberia is assumed, there is a demand for a martensitic stainless steel material that has excellent low-temperature toughness in an extremely low-temperature environment of −50° C. or less that is far below normal temperature. Specifically, there is a demand for a martensitic stainless steel material that has a yield strength of 125 ksi or more (862 MPa or more), excellent low-temperature toughness in an extremely low-temperature environment, and excellent corrosion resistance.

In the aforementioned Patent Literatures 1 to 3, although martensitic stainless steel materials having high strength and excellent corrosion resistance are proposed, low-temperature toughness has not been investigated. In the aforementioned Patent Literature 4, although a martensitic stainless steel material having high strength, excellent low-temperature toughness, and excellent corrosion resistance is proposed, low-temperature toughness in an extremely low-temperature environment of −50° C. or less has not been investigated.

An objective of the present disclosure is to provide a martensitic stainless steel material which has a yield strength of 125 ksi or more, excellent low-temperature toughness in an extremely low-temperature environment, and excellent corrosion resistance, and a method for producing the martensitic stainless steel material.

Solution to Problem

A martensitic stainless steel material according to the present disclosure consists of, in mass %, C: less than 0.030%,
Si: 1.00% or less,
Mn: 0.05 to 2.00%,
P: 0.050% or less,
S: 0.0050% or less,
Cr: 11.50 to 14.00%,
Ni: 5.00 to 7.50%,
Mo: 1.10 to 3.50%,
Cu: 0.50 to 3.50%,
Co: 0.01 to 0.30%,
Al: 0.001 to 0.100%,
N: 0.001 to 0.100%,
O: 0.010% or less,
W: 0 to 2.00%,
V: 0 to 0.300%,
Ti: 0 to 0.300%,
Nb: 0 to 0.300%,
Ca: 0 to 0.0100%,
Mg: 0 to 0.0100%,
rare earth metal: 0 to 0.100%,
B: 0 to 0.0100%, and
the balance: Fe and impurities,
wherein:

a microstructure is composed of, in vol %, retained austenite in an amount of 0 to 15%, and ferrite in an amount of 0 to 10%, with the balance being martensite;

a yield strength is 862 MPa or more; and a number density of Cu precipitates in the steel material is $3.0\times10^{21}$ to $50.0\times10^{21}/m^3$.

A method for producing a martensitic stainless steel material according to the present disclosure is a method for producing the above described martensitic stainless steel material, including:

a preparation process of preparing an intermediate steel material consisting of, in mass %,
C: less than 0.030%,
Si: 1.00% or less,
Mn: 0.05 to 2.00%,
P: 0.050% or less,
S: 0.0050% or less,
Cr: 11.50 to 14.00%,
Ni: 5.00 to 7.50%,
Mo: 1.10 to 3.50%,
Cu: 0.50 to 3.50%,
Co: 0.01 to 0.30%,
Al: 0.001 to 0.100%,
N: 0.001 to 0.100%,
O: 0.010% or less,
W: 0 to 2.00%,
V: 0 to 0.300%,
Ti: 0 to 0.300%,
Nb: 0 to 0.300%,
Ca: 0 to 0.0100%,
Mg: 0 to 0.0100%,
rare earth metal: 0 to 0.100%,
B: 0 to 0.0100%, and,
the balance: Fe and impurities:

a quenching process of, after the preparation process, quenching the intermediate steel material at a temperature of 800 to 1000° C.;

a first tempering process of tempering the intermediate steel material after the quenching process, at a tempering temperature of 500 to 545° C. for a tempering time of 5 to 60 minutes; and a second tempering process of tempering the intermediate steel material after the first tempering process, at a tempering temperature of 555 to 650° C. for a tempering time of 10 to 90 minutes.

Advantageous Effects of Invention

The martensitic stainless steel material according to the present disclosure has a yield strength of 125 ksi or more, excellent low-temperature toughness in an extremely low-temperature environment, and excellent corrosion resistance. According to the method for producing a martensitic stainless steel material of the present disclosure, a martensitic stainless steel material that has a yield strength of 125 ksi or more, excellent low-temperature toughness in an extremely low-temperature environment, and excellent corrosion resistance can be produced.

DESCRIPTION OF EMBODIMENTS

First, the present inventors conducted studies with regard to a martensitic stainless steel material having a yield strength of 125 ksi or more, excellent low-temperature toughness in an extremely low-temperature environment, and excellent corrosion resistance, from the viewpoint of the chemical composition. As a result, the present inventors found that when a martensitic stainless steel material consists of, in mass %, C: less than 0.030%, Si: 1.00% or less, Mn: 0.05 to 2.00%, P: 0.050% or less, S: 0.0050% or less, Cr: 11.50 to 14.00%, Ni: 5.00 to 7.50%, Mo: 1.10 to 3.50%, Cu: 0.50 to 3.50%, Co: 0.01 to 0.30%, Al: 0.001 to 0.100%. N: 0.001 to 0.100%, O: 0.010% or less, W: 0 to 2.00%, V: 0 to 0.300%, Ti: 0 to 0.300%, Nb: 0 to 0.300%, Ca: 0 to 0.0100%, Mg: 0 to 0.0100%, rare earth metal: 0 to 0.100%, B: 0 to 0.0100%, and the balance: Fe and impurities, a martensitic stainless steel material having excellent corrosion resistance is obtained.

On the other hand, up to now it has been considered that as the strength of a steel material increases, the low-temperature toughness of the steel material decreases. In other words, in a martensitic stainless steel material having the above described chemical composition, there is a possibility that, as a result of increasing the yield strength, the low-temperature toughness cannot be sufficiently obtained in an extremely low-temperature environment. Therefore, the present inventors conducted detailed studies regarding means for increasing not only the corrosion resistance of the steel material, but also both the yield strength and the low-temperature toughness. As a result, the present inventors discovered that by causing fine Cu precipitates to precipitate in a large amount in the steel material, a yield strength of 125 ksi or more and excellent low-temperature toughness in an extremely low-temperature environment can be compatibly achieved while maintaining the corrosion resistance.

The present inventors consider that the reason for this is as follows. As mentioned above, the martensitic stainless steel material according to the present embodiment contains Cu in an amount of 0.50 to 3.50%. As a result, when it is attempted to increase the yield strength of a martensitic stainless steel material having the above described chemical composition to 125 ksi or more, some or all of the Cu contained in the steel material precipitates in the steel material as precipitate.

On the other hand, the influence Cu precipitates have on the mechanical properties of a steel material differs depending on the size of the Cu precipitates. Specifically, it is considered that although fine Cu precipitates increase the yield strength of a steel material by precipitation strengthening, such fine Cu precipitates have almost no influence on the low-temperature toughness of a steel material. On the other hand, although coarse Cu precipitates significantly increase the yield strength of a steel material, they significantly reduce the low-temperature toughness of the steel material. In particular, in an extremely low-temperature environment such as an environment of −50° C., the influence of coarse Cu precipitates noticeably appears. Furthermore, when coarse Cu precipitates precipitate, the volume per single Cu precipitate is large. Therefore, the number density of coarse Cu precipitates decreases. In other words, the higher the number density of Cu precipitates, the finer Cu precipitates precipitate and the fewer the number of coarse Cu precipitates. Consequently, the yield strength of the steel material increases, and in addition, a decrease in the low-temperature toughness of the steel material which is caused by coarse Cu precipitates is reduced. Thus, the present inventors consider that in a martensitic stainless steel material having the above described chemical composition and microstructure, by increasing the number density of Cu precipitates to $3.0\times10^{21}/m^3$ or more, a yield strength of 125 ksi or more, excellent low-temperature toughness in an extremely low-temperature environment, and excellent corrosion resistance will be obtained.

There is also a possibility that, in a case where the number density of Cu precipitates in the steel material according to the present embodiment is $3.0\times10^{21}/m^3$ or more, the low-temperature toughness of the steel material in an extremely low-temperature environment noticeably is increased by another mechanism that is different from the mechanism described above while the yield strength and the corrosion resistance are maintained. However, it has been demonstrated as described in EXAMPLE below that when the number density of Cu precipitates is made $3.0\times10^{21}/m^3$ or more, on the condition that the other requirements according to the present embodiment are satisfied, a martensitic stainless steel material having a yield strength of 125 ksi or more, excellent low-temperature toughness in an extremely low-temperature environment, and excellent corrosion resistance is obtained.

Note that, in a martensitic stainless steel material having the above described chemical composition and microstructure, an upper limit of the number density of Cu precipitates is substantially $50.0\times10^{21}/m^3$. Accordingly, the martensitic stainless steel material according to the present embodiment has the above described chemical composition and the above described microstructure, and furthermore, the number density of Cu precipitates in the martensitic stainless steel material is $3.0\times10^{21}$ to $50.0\times10^{21}/m^3$. As a result, the martensitic stainless steel material according to the present embodiment has a yield strength of 125 ksi or more, excellent low-temperature toughness in an extremely low-temperature environment, and excellent corrosion resistance.

The gist of the martensitic stainless steel material according to the present embodiment and a method for producing the martensitic stainless steel material according to the present embodiment which have been completed based on the above findings is as follows.

[1]

A martensitic stainless steel material, consisting of, in mass %,

C: less than 0.030%,
Si: 1.00% or less,
Mn: 0.05 to 2.00%,
P: 0.050% or less,
S: 0.0050% or less,
Cr: 11.50 to 14.00%,
Ni: 5.00 to 7.50%,
Mo: 1.10 to 3.50%,
Cu: 0.50 to 3.50%,
Co: 0.01 to 0.30%,
Al: 0.001 to 0.100%,
N: 0.001 to 0.100%,
O: 0.010% or less,
W: 0 to 2.00%,
V: 0 to 0.300%,
Ti: 0 to 0.300%,
Nb: 0 to 0.300%,
Ca: 0 to 0.0100%,
Mg: 0 to 0.0100%,
rare earth metal: 0 to 0.100%,
B: 0 to 0.0100%, and
the balance: Fe and impurities,
wherein:

a microstructure is composed of, in vol %, retained austenite in an amount of 0 to 15%, and ferrite in an amount of 0 to 10%, with the balance being martensite;
a yield strength is 862 MPa or more; and
a number density of Cu precipitates in the steel material is $3.0\times10^{21}$ to $50.0\times10^{21}/m^3$.

[2]

The martensitic stainless steel material according to [1], containing one or more elements selected from the group consisting of:

W: 0.01 to 2.00%,
V: 0.001 to 0.300%,
Ti: 0.001 to 0.300%,
Nb: 0.001 to 0.300%,
Ca: 0.0010 to 0.0100%,
Mg: 0.0010 to 0.0100%,
rare earth metal: 0.001 to 0.100%, and
B: 0.0001 to 0.0100%.

[3]

A method for producing the martensitic stainless steel material according to [1] or [2], including:

a preparation process of preparing an intermediate steel material consisting of, in mass %, C: less than 0.030%,
Si: 1.00% or less,
Mn: 0.05 to 2.00%,
P: 0.050% or less,
S: 0.0050% or less,
Cr: 11.50 to 14.00%,
Ni: 5.00 to 7.50%,
Mo: 1.10 to 3.50%,
Cu: 0.50 to 3.50%,
Co: 0.01 to 0.30%,
Al: 0.001 to 0.100%,
N: 0.001 to 0.100%,
O: 0.010% or less,
W: 0 to 2.00%,
V: 0 to 0.300%,
Ti: 0 to 0.300%, Nb: 0 to 0.300%,
Ca: 0 to 0.0100%,
Mg: 0 to 0.0100%,
rare earth metal: 0 to 0.100%,
B: 0 to 0.0100%, and
the balance: Fe and impurities;

a quenching process of, after the preparation process, quenching the intermediate steel material at a temperature of 800 to 1000° C.;

a first tempering process of tempering the intermediate steel material after the quenching process, at a tempering temperature of 500 to 545° C. for a tempering time of 5 to 60 minutes; and a second tempering process of tempering the intermediate steel material after the first tempering process, at a tempering temperature of 555 to 650° C. for a tempering time of 10 to 90 minutes.

[4]

The method for producing the martensitic stainless steel material according to [3], wherein the intermediate steel material contains one or more elements selected from the group consisting of:

W: 0.01 to 2.00%,
V: 0.001 to 0.300%,
Ti: 0.001 to 0.300%,
Nb: 0.001 to 0.300%,
Ca: 0.0010 to 0.0100%,
Mg: 0.0010 to 0.0100%,
rare earth metal: 0.001 to 0.100%, and
B: 0.0001 to 0.0100%

The martensitic stainless steel material according to the present embodiment will be described in detail below. Note that the sign "%" following each element means mass percent unless otherwise noted.

[Chemical Composition]

The chemical composition of the martensitic stainless steel material of the present embodiment contains the following elements.

C: Less than 0.030%

Carbon (C) is unavoidably contained. In other words, a lower limit of the C content is more than 0%. C improves hardenability of the steel material, thus increasing the strength of the steel material. On the other hand, if the C content is too high, even if the contents of other elements are within the range of the present embodiment, the strength of the steel material will become too high and the corrosion resistance of the steel material will decrease. Accordingly, the C content is less than 0.030%. An upper limit of the C content is preferably 0.025%, more preferably 0.020%, and further preferably 0.015%. The C content is preferably as low as possible. However, extremely reducing the C content will result in a significant increase in the production cost. Therefore, considering industrial production, a lower limit of the C content is preferably 0.0001%, more preferably 0.001%, and further preferably 0.002%.

Si: 1.00% or Less

Silicon (Si) deoxidizes steel, and is unavoidably contained in the steel material. In other words, a lower limit of the Si content is more than 0%. On the other hand, if the Si content is too high, hot workability of the steel material will decrease even if the contents of other elements are within the range of the present embodiment. Accordingly, the Si content is 1.00% or less. An upper limit of the Si content is preferably 0.80%, more preferably 0.65%, and further preferably 0.50%. However, extremely reducing the Si content will result in a significant increase in the production cost. Therefore, considering industrial production, a lower limit of the Si content is preferably 0.001%, more preferably 0.01%, and further preferably 0.02%.

Mn: 0.05 to 2.00%

Manganese (Mn) improves hardenability of the steel material, thus increasing the strength of the steel material. If the Mn content is too low, even if the contents of other elements are within the range of the present embodiment, the aforementioned effect cannot be sufficiently obtained. On the other hand, if the Mn content is too high, coarse inclusions will be formed and the low-temperature toughness of the steel material will decrease even if the contents of other elements are within the range of the present embodiment. Accordingly, the Mn content is 0.05 to 2.00%. A lower limit of the Mn content is preferably 0.07%, more preferably 0.10%, and further preferably 0.15%. An upper limit of the Mn content is preferably 1.80%, more preferably 1.50%, further preferably 1.20%, and further preferably 1.00%.

P: 0.050% or Less

Phosphorus (P) is an impurity which is unavoidably contained. In other words, a lower limit of the P content is more than 0%. If the P content is too high, even if the contents of other elements are within the range of the present embodiment, P will segregate at grain boundaries, thereby decreasing the low-temperature toughness and the corrosion resistance of the steel material. Accordingly, the P content is 0.050% or less. An upper limit of the P content is preferably 0.040%, and more preferably 0.030%. The P content is preferably as low as possible. However, extremely reducing the P content will result in a significant increase in the production cost. Therefore, considering industrial production, a lower limit of the P content is preferably 0.0001%, more preferably 0.001%, and further preferably 0.002%.

S: 0.0050% or Less

Sulfur(S) is an impurity which is unavoidably contained. In other words, a lower limit of the S content is more than 0%. If the S content is too high, even if the contents of other elements are within the range of the present embodiment, S will segregate at grain boundaries, thereby decreasing the low-temperature toughness and the corrosion resistance of the steel material. Accordingly, the S content is 0.0050% or less. An upper limit of the S content is preferably 0.0040%, more preferably 0.0030%, and further preferably 0.0020%. The S content is preferably as low as possible. However, extremely reducing the S content will result in a significant increase in the production cost. Therefore, considering industrial production, a lower limit of the S content is preferably 0.0001%, more preferably 0.0002%, and further preferably 0.0003%.

Cr: 11.50 to 14.00%

Chromium (Cr) forms a film on the surface of the steel material, thereby increasing the corrosion resistance of the steel material. If the Cr content is too low. the aforementioned effect cannot be sufficiently obtained even if the contents of other elements are within the range of the present embodiment. On the other hand, if the Cr content is too high, even if the contents of other elements are within the range of the present embodiment, the ferrite content in the microstructure of the steel material after tempering will be too high, and the low-temperature toughness of the steel material will decrease. Accordingly, the Cr content is 11.50 to 14.00%. A lower limit of the Cr content is preferably 11.70%, and more preferably 12.00%. An upper limit of the Cr content is preferably 13.80%, and more preferably 13.50%.

Ni: 5.00 to 7.50%

Nickel (Ni) increases the corrosion resistance of the steel material. If the Ni content is too low, the aforementioned effect cannot be sufficiently obtained even if the contents of other elements are within the range of the present embodiment. Further, Ni is an austenite forming element and causes the microstructure of the steel material after quenching to be martensitic. Therefore, if the Ni content is too low, even if the contents of other elements are within the range of the present embodiment, the ferrite content in the microstructure of the steel material after tempering will be too high, and the low-temperature toughness of the steel material will decrease. On the other hand, if the Ni content is too high, even if the contents of other elements are within the range of the present embodiment, the Act transformation point will become too low, thus making it difficult to perform thermal refining of the steel material. Consequently, desired mechanical properties of the steel material will not be obtained. Therefore, the Ni content is 5.00 to 7.50%. A lower limit of the Ni content is preferably more than 5.00%, more preferably 5.10%, further preferably 5.20%, and further preferably 5.30%. An upper limit of the Ni content is preferably 7.30%, more preferably 7.20%, and further preferably 7.00%.

Mo: 1.10 to 3.50%

Molybdenum (Mo) increases the strength of the steel material. Mo also forms a film on the surface of the steel material, thereby increasing the corrosion resistance of the steel material. If the Mo content is too low, the aforementioned effects cannot be sufficiently obtained even if the contents of other elements are within the range of the present embodiment. On the other hand, Mo is a ferrite forming element. Therefore, if the Mo content is too high, even if the contents of other elements are within the range of the present embodiment, the ferrite content in the microstructure of the steel material after tempering will be too high, and the low-temperature toughness of the steel material will decrease. Accordingly, the Mo content is 1.10 to 3.50%. A lower limit of the Mo content is preferably 1.20%, more preferably 1.40%, further preferably 1.50%, further preferably 1.70%, further preferably 1.80%, and further preferably 2.00%. An upper limit of the Mo content is preferably less than 3.50%, more preferably 3.40%, further preferably 3.20%, and further preferably 3.00%.

Cu: 0.50 to 3.50%

Copper (Cu) precipitates as Cu precipitates in the steel material, thereby increasing the strength of the steel material. If the Cu content is too low, the aforementioned effect cannot be sufficiently obtained even if the contents of other elements are within the range of the present embodiment. On the other hand, if the Cu content is too high, even if the contents of other elements are within the range of the present embodiment, the strength of the steel material will be too high and the corrosion resistance and/or the low-temperature toughness of the steel material will decrease. Accordingly, the Cu content is 0.50 to 3.50%. A lower limit of the Cu content is preferably 0.60%, more preferably 0.70%, and further preferably 0.80%. An upper limit of the Cu content is preferably less than 3.50%, more preferably 3.45%, further preferably 3.40%, and further preferably 3.20%.

Co: 0.01 to 0.30%

Cobalt (Co) forms a film on the surface of the steel material, thereby increasing the corrosion resistance of the steel material. Co also increases hardenability of the steel material and stabilizes the strength of the steel material. If the Co content is too low, the aforementioned effects cannot be sufficiently obtained even if the contents of other elements are within the range of the present embodiment. On the other hand, if the Co content is too high, the aforementioned effects will be saturated. Further, if the Co content is too high, the production cost will increase extremely. Accordingly, the Co content is 0.01 to 0.30%. A lower limit of the Co content is preferably 0.02%, more preferably 0.05%, and further preferably 0.09%. An upper limit of the Co content is preferably 0.27%, and more preferably 0.25%.

Al: 0.001 to 0.100%

Aluminum (Al) deoxidizes steel. If the Al content is too low, the aforementioned effect cannot be sufficiently obtained even if the contents of other elements are within the range of the present embodiment. On the other hand, if the Al content is too high, the aforementioned effect will be saturated. Accordingly, the Al content is 0.001 to 0.100%. A lower limit of the Al content is preferably 0.003%, more preferably 0.005%, and further preferably 0.010%. An upper limit of the Al content is preferably 0.090%, more preferably 0.080%, further preferably 0.070%, and further preferably 0.060%. Note that, the term "Al content" as used in the present description means the content of sol. Al (acid soluble Al).

N: 0.001 to 0.100%

Nitrogen (N) increases the corrosion resistance of the steel material. If the N content is too low, the aforementioned effect cannot be sufficiently obtained even if the contents of other elements are within the range of the present embodiment. On the other hand, if the N content is too high, even if the contents of other elements are within the range of the present embodiment, coarse nitrides will be formed and the corrosion resistance of the steel material will decrease. Accordingly, the N content is 0.001 to 0.100%. A lower limit of the N content is preferably 0.002%, and more preferably 0.003%. An upper limit of the N content is preferably 0.090%, more preferably 0.080%, and further preferably 0.070%.

O: 0.010% or Less

Oxygen (O) is an impurity which is unavoidably contained. In other words, a lower limit of the O content is more than 0%. If the O content is too high, even if the contents of other elements are within the range of the present embodiment, coarse oxide-based inclusions will be formed and the low-temperature toughness of the steel material will decrease. Accordingly, the O content is 0.010% or less. An upper limit of the O content is preferably 0.008%, more preferably 0.006%, and further preferably 0.005%. The O content is preferably as low as possible. However, extremely reducing the O content will result in a significant increase in the production cost. Therefore, considering industrial production, a lower limit of the O content is preferably 0.0001%, more preferably 0.001%, and further preferably 0.002%.

The balance of the chemical composition of the martensitic stainless steel material according to the present embodiment is Fe and impurities. Here, the term "impurities" refers to elements which, during industrial production of the steel material, are mixed in from ore or scrap that is used as the raw material, or from the production environment or the like, and which are not intentionally contained, but are allowed within a range that does not adversely affect the martensitic stainless steel material according to the present embodiment.

[Regarding Optional Elements]

[First Group of Optional Elements]

The chemical composition of the martensitic stainless steel material according to the present embodiment may further contain W in lieu of part of Fe.

W: 0 to 2.00%

Tungsten (W) is an optional element and does not have to be contained. In other words, the W content may be 0%.

When contained, W stabilizes a film on the surface of the steel material, thereby increasing the corrosion resistance of the steel material. When W is contained even in a small amount, the aforementioned effect can be obtained to some extent. On the other hand, if the W content is too high, even if the contents of other elements are within the range of the present embodiment, coarse carbides will be formed and the low-temperature toughness of the steel material will decrease. Therefore, the W content is 0 to 2.00%. A lower limit of the W content is preferably more than 0%, more preferably 0.01%, further preferably 0.02%, further preferably 0.10%, further preferably 0.15%, and further preferably 0.20%. An upper limit of the W content is preferably 1.80%, and more preferably 1.50%.

[Second Group of Optional Elements]

The chemical composition of the martensitic stainless steel material according to the present embodiment may further contain one or more elements selected from the group consisting of V. Ti, and Nb in lieu of part of Fe. Each of these elements is an optional element, and increases the strength of the steel material.

V: 0 to 0.300%

Vanadium (V) is an optional element and does not have to be contained. In other words, the V content may be 0%. When contained, V forms carbides, nitrides, or carbo-nitrides (hereinafter, also referred to as "carbo-nitrides and the like") and thereby increases the strength of the steel material. When V is contained even in a small amount, the aforementioned effect can be obtained to some extent. On the other hand, if the V content is too high, even if the contents of other elements are within the range of the present embodiment, the strength of the steel material will become too high, and the low-temperature toughness of the steel material will decrease. Therefore, the V content is 0 to 0.300%. A lower limit of the V content is preferably more than 0%, more preferably 0.001%, further preferably 0.005%, and further preferably 0.010%. An upper limit of the V content is preferably 0.290%, more preferably 0.250%, and further preferably 0.200%.

Ti: 0 to 0.300%

Titanium (Ti) is an optional element and does not have to be contained. In other words, the Ti content may be 0%. When contained, Ti forms carbo-nitrides and the like and thereby increases the strength of the steel material. When Ti is contained even in a small amount, the aforementioned effect can be obtained to some extent. On the other hand, if the Ti content is too high, even if the contents of other elements are within the range of the present embodiment, the strength of the steel material will become too high, and the low-temperature toughness of the steel material will decrease. Therefore, the Ti content is 0 to 0.300%. A lower limit of the Ti content is preferably more than 0%, more preferably 0.001%, further preferably 0.005%, and further preferably 0.010%. An upper limit of the Ti content is preferably 0.290%, more preferably 0.250%, and further preferably 0.200%

Nb: 0 to 0.300%

Niobium (Nb) is an optional element and does not have to be contained. In other words, the Nb content may be 0%. When contained, Nb forms carbo-nitrides and the like and thereby increases the strength of the steel material. If Nb is contained even in a small amount, the aforementioned effect can be obtained to some extent. On the other hand, if the Nb content is too high, even if the contents of other elements are within the range of the present embodiment, the strength of the steel material will become too high, and the low-temperature toughness of the steel material will decrease. Therefore, the Nb content is 0 to 0.300%. A lower limit of the Nb content is preferably more than 0%, more preferably 0.001%, further preferably 0.005%, and further preferably 0.010%. An upper limit of the Nb content is preferably 0.290%, more preferably 0.250%, and further preferably 0.200%.

[Third Group of Optional Elements]

The chemical composition of the martensitic stainless steel material according to the present embodiment may further contain one or more elements selected from the group consisting of Ca, Mg, rare earth metal (REM), and B in lieu of part of Fe. Each of these elements is an optional element, and increases hot workability of the steel material.

Ca: 0 to 0.0100%

Calcium (Ca) is an optional element and does not have to be contained. In other words, the Ca content may be 0%. When contained, Ca renders S in the steel material harmless by forming sulfides, and increases hot workability of the steel material. If Ca is contained even in a small amount, the aforementioned effect can be obtained to some extent. On the other hand, if the Ca content is too high, even if the contents of other elements are within the range of the present embodiment. inclusions in the steel material will coarsen and the low-temperature toughness of the steel material will decrease. Therefore, the Ca content is 0 to 0.0100%. A lower limit of the Ca content is preferably more than 0%, more preferably 0.0001%, further preferably 0.0005%, and further preferably 0.0010%. An upper limit of the Ca content is preferably 0.0090%, and more preferably 0.0080%.

Mg: 0 to 0.0100%

Magnesium (Mg) is an optional element and does not have to be contained. In other words, the Mg content may be 0%. When contained, Mg renders S in the steel material harmless by forming sulfides, and increases hot workability of the steel material. If Mg is contained even in a small amount, the aforementioned effect can be obtained to some extent. On the other hand, if the Mg content is too high, even if the contents of other elements are within the range of the present embodiment, inclusions in the steel material will coarsen and the low-temperature toughness of the steel material will decrease. Therefore, the Mg content is 0 to 0.0100%. A lower limit of the Mg content is preferably more than 0%, more preferably 0.0001%, further preferably 0.0005%, and further preferably 0.0010%. An upper limit of the Mg content is preferably 0.0090%, and more preferably 0.0080%.

Rare Earth Metal: 0 to 0.100%

Rare earth metal (REM) is an optional element and does not have to be contained. In other words, the REM content may be 0%. When contained, REM renders S in the steel material harmless by forming sulfides, and increases hot workability of the steel material. If REM is contained even in a small amount, the aforementioned effect can be obtained to some extent. On the other hand, if the REM content is too high, even if the contents of other elements are within the range of the present embodiment, inclusions in the steel material will coarsen and the low-temperature toughness of the steel material will decrease. Therefore, the REM content is 0 to 0.100%. A lower limit of the REM content is preferably more than 0%, more preferably 0.001%, further preferably 0.005%, and further preferably 0.010%. An upper limit of the REM content is preferably 0.090%, and more preferably 0.080%.

Note that, in the present description the term "REM" means one or more types of element selected from the group consisting of scandium (Se) which is the element with atomic number 21, yttrium (Y) which is the element with atomic number 39, and the elements from lanthanum (La) with atomic number 57 to lutetium (Lu) with atomic number 71 that are lanthanoids. Further, in the present description the term "REM content" refers to the total content of these elements.

B: 0 to 0.0100%

Boron (B) is an optional element and does not have to be contained. In other words, the B content may be 0%. When contained, B suppresses segregation of S in the steel material at crystal grain boundaries, thereby improving hot workability of the steel material. If B is contained even in a small amount, the aforementioned effect can be obtained to some extent. On the other hand, if the B content is too high, even if the contents of other elements are within the range of the present embodiment, nitrides will be formed and the low-temperature toughness of the steel material will decrease. Therefore, the B content is 0 to 0.0100%. A lower limit of the B content is preferably more than 0%, more preferably 0.0001%, further preferably 0.0005%, and further preferably 0.0010%. An upper limit of the B content is preferably 0.0090%, more preferably 0.0080%, and further preferably 0.0050%.

[Microstructure]

The microstructure of the martensitic stainless steel material according to the present embodiment is composed of, in vol %, retained austenite in an amount of 0 to 15% and ferrite in an amount of 0 to 10%, with the balance being martensite. As used herein, the term "martensite" is a generic term that includes not only fresh martensite which is formed during quenching, but also tempered martensite. In addition, as used herein, the phrase "composed of retained austenite, ferrite, and martensite" means that the amount of any phase other than retained austenite, ferrite, and martensite is negligibly small. For example, in the martensitic stainless steel material having the above described chemical composition according to the present embodiment, the volume ratios of precipitates and inclusions are negligibly small in comparison to the volume ratios of retained austenite, ferrite, and martensite. In other words, the microstructure of the martensitic stainless steel material according to the present embodiment may contain minute amounts of precipitates, inclusions or the like, in addition to retained austenite, ferrite, and martensite.

As described above, in the microstructure of the martensitic stainless steel material according to the present embodiment, the volume ratio of retained austenite is 0 to 15%, and the volume ratio of ferrite is 0 to 10%. In other words, in the microstructure of the martensitic stainless steel material according to the present embodiment, the volume ratio of martensite is 75 to 100%. If the volume ratios of retained austenite and ferrite are too high, control of the mechanical properties of the steel material will be difficult. On the other hand, a lower limit of the volume ratios of retained austenite and ferrite may be 0%. In other words, the martensitic stainless steel material according to the present embodiment may have a microstructure consisting only of martensite.

In the present embodiment, in the microstructure, a lower limit of the volume ratio of retained austenite may be 1%, or may be 2%. In addition, in the microstructure, an upper limit of the volume ratio of retained austenite may be 13%, or may be 10%. In the present embodiment, in the microstructure, a lower limit of the volume ratio of ferrite may be 1%, or may be 2%. In addition, in the microstructure, an upper limit of the volume ratio of ferrite may be 8%, or may be 5%

[Method for Measuring Volume Ratio of Retained Austenite]

The volume ratio (%) of retained austenite in the microstructure of the martensitic stainless steel material of the present embodiment can be obtained by the method described hereunder.

The volume ratio of retained austenite is obtained by an X-ray diffraction method. Specifically, a test specimen is prepared from the martensitic stainless steel material. If the steel material is a steel plate, the test specimen is prepared from a center portion of the plate thickness. If the steel material is a pipe, the test specimen is prepared from a center portion of the wall thickness. If the steel material is a steel bar having a circular cross section, the test specimen is prepared from an R/2 position. As used herein, the term "R/2 position" means the center position of a radius R in a cross section perpendicular to the longitudinal direction of the steel bar. The size of the test specimen is, although not particularly limited, for example. 15 mm×15 mm×a thickness of 2 mm. In this case, the thickness direction of the test specimen is parallel to the plate thickness direction, the wall thickness (pipe diameter) direction, or radius R direction in the cross section perpendicular to the longitudinal direction of the steel bar. By using the prepared test specimen, the X-ray diffraction intensity of each of the (200) plane of α phase (ferrite and martensite), the (211) plane of α phase, the (200) plane of γ phase (retained austenite), the (220) plane of γ phase, and the (311) plane of γ phase is measured to calculate an integrated intensity of each plane.

In the measurement of the X-ray diffraction intensity, the target of the X-ray diffraction apparatus is Mo (Mo Ka radiation). After calculation, the volume ratio Vγ (%) of retained austenite is calculated using Formula (I) for combinations (2×3=6 pairs) of each plane of the α phase and each plane of the γ phase. Then, an average value of the volume ratios Vγ of retained austenite of the six pairs is defined as the volume ratio (%) of retained austenite.

$$V\gamma=100/\{1+(I\alpha\times R\gamma)/(I\gamma\times R\alpha)\} \quad \text{(I)}$$

Where, Iα is an integrated intensity of α phase. Rα is a crystallographic theoretical calculation value of α phase, Iγ is an integrated intensity of γ phase. Rγ is a crystallographic theoretical calculation value of γ phase. In the present description. Rα in the (200) plane of α phase is 15.9, Rα in the (211) plane of α phase is 29.2, Rγ in the (200) plane of γ phase is 35.5, Rγ in the (220) plane of γ phase is 20.8, and Rγ in the (311) plane of γ phase is 21.8. Note that the volume ratio of retained austenite is obtained by rounding off the first decimal place of an obtained numerical value.

[Method for Measuring Volume Ratio of Ferrite]

The volume ratio (%) of ferrite in the microstructure of the martensitic stainless steel material of the present embodiment can be obtained by the method described hereunder.

The volume ratio of ferrite is obtained by a point counting method in conformity with JIS G 0555 (2003). Specifically, a test specimen is prepared from the martensitic stainless steel material. If the steel material is a steel plate, the test specimen is prepared from a center portion of the plate thickness. If the steel material is a pipe, the test specimen is prepared from a center portion of the wall thickness. If the steel material is a steel bar having a circular cross section, the test specimen is prepared from an R/2 position. It suffices that the test specimen has an observation surface perpendicular to the rolling direction, and the size thereof is not particularly limited. The test specimen is embedded in resin, and the observation surface polished into a mirror surface is immersed in Vilella's reagent (a mixed solution of ethanol, hydrochloric acid, and picric acid) for about 60 seconds, and then etched to reveal the microstructure. Ten visual fields in the etched observation surface are observed using an optical microscope. The visual field area is not particularly limited, and for example is 1.00 $mm^2$ (magnification of 100 times).

For those skilled in the art, it is possible to distinguish ferrite from other phases based on contrast in each observation visual field. Therefore, ferrite in each observation visual field is identified based on contrast. The area fraction of the identified ferrite is determined by a point counting method in conformity with JIS G 0555 (2003). The arithmetic average value of the area fractions of ferrite determined in the 10 visual fields is defined as the volume ratio (%) of ferrite. Note that, the volume ratio of ferrite is obtained by rounding off the first decimal place of an obtained numerical value.

[Method for Measuring Volume Ratio of Martensite]

The volume ratio (%) of martensite in the microstructure of the martensitic stainless steel material of the present embodiment can be obtained by the method described hereunder. Specifically, using the volume ratio (%) of retained austenite obtained by the aforementioned X-ray diffraction method, and the volume ratio (%) of ferrite obtained by the aforementioned point counting method, the volume ratio (%) of martensite is obtained by the following formula.

Volume ratio (%) of martensite=100−volume ratio (%) of retained austenite volume ratio (%) of ferrite

[Yield Strength]

The martensitic stainless steel material according to the present embodiment has a yield strength of 862 MPa or more (125 ksi or more). As used herein, the term "yield strength" means 0.2% offset proof stress obtained by a tensile test. Even though the martensitic stainless steel material according to the present embodiment has a yield strength of 125 ksi or more, by having the above described chemical composition and microstructure, and Cu precipitates to be described later, the martensitic stainless steel material according to the present embodiment has the excellent low-temperature toughness and the excellent corrosion resistance. Note that, in the present embodiment, an upper limit of the yield strength of the martensitic stainless steel material is not particularly limited. The upper limit of the yield strength, for example, may be 1069 MPa (155 ksi), may be 1034 MPa (150 ksi), may be 1000 MPa (145 ksi), may be 965 MPa (140 ksi), or may be less than 965 MPa (less than 140 ksi).

The yield strength of the martensitic stainless steel material according to the present embodiment can be determined by the following method. A round bar specimen is prepared from the steel material according to the present embodiment. If the steel material is a steel plate, the round bar specimen is prepared from a center portion of the plate thickness. If the steel material is a pipe, the round bar specimen is prepared from a center portion of the wall thickness. If the steel material is a steel bar having a circular cross section, the round bar specimen is prepared from an R/2 position. The size of the round bar specimen is, for example, as follows: a parallel portion diameter is 4 mm and a parallel portion length is 35 mm. Note that the axial direction of the round bar specimen is parallel with the rolling direction of the steel material. A tensile test is carried out at normal temperature (24+3° C.) in conformity with ASTM E8/E8M (2013) using the round bar specimen, and the obtained 0.2% offset proof stress (MPa) is defined as the yield strength (MPa).

[Cu Precipitates]

The martensitic stainless steel material according to the present embodiment has the above described chemical composition and the above described microstructure, and in addition, the number density of Cu precipitates in the martensitic stainless steel material is $3.0\times10^{21}$ to $50.0\times10^{21}/m^3$. As a result, even though the yield strength thereof is 125 ksi or more (862 MPa or more), the martensitic stainless steel material according to the present embodiment has the excellent low-temperature toughness in an extremely low-temperature environment and the excellent corrosion resistance. In the present description, the term "Cu precipitates" means precipitates composed of Cu and impurities. Specifically, in the present embodiment, in elementary analysis performed by Energy Dispersive X-ray Spectrometry (hereunder, also referred to as "EDS") to be described later, when elements to be quantified set as Fe. Cr, Ni, Cu, Mn, Mo, and Si, precipitates in which 15.0 mass % or more of Cu is detected are defined as "Cu precipitates".

As mentioned above, in a martensitic stainless steel material having the above described chemical composition and the above described microstructure, some or all of the Cu is precipitated as Cu precipitates. Therefore, a case where the total volume of Cu precipitates is itself small (that is, the dissolved amount of Cu is large), and a case where the total volume of Cu precipitates does not change and the number of Cu precipitates decreases are conceivable as cases where the number density of Cu precipitates is small. Among these, in a case where the total volume of Cu precipitates is small, the effect of precipitation strengthening by Cu precipitates cannot be sufficiently obtained, and a yield strength of 125 ksi or more cannot be obtained in the steel material. On the other hand, in a case where even though the total volume of Cu precipitates is large, the number of Cu precipitates decreases, coarse Cu precipitates mainly precipitate, and the excellent low-temperature toughness cannot be obtained in the steel material.

In other words, when the number density of Cu precipitates is high, a large amount of fine Cu precipitates are precipitated, and precipitation of coarse Cu precipitates is suppressed to a small amount. Consequently, a yield strength of 125 ksi or more and the excellent low-temperature toughness can be obtained in the steel material while maintaining excellent corrosion resistance. Specifically, in the martensitic stainless steel material according to the present embodiment, when the number density of Cu precipitates is $3.0\times10^{21}/m^3$ or more, on the condition that the other requirements according to the present embodiment are satisfied, a yield strength of 125 ksi or more, the excellent low-temperature toughness, and the excellent corrosion resistance are obtained. Note that, in the martensitic stainless steel material according to the present embodiment, the higher an upper limit of the number density of Cu precipitates is, the more preferable it is. However, in the martensitic stainless steel material according to the present embodiment for which the above described chemical composition and microstructure are taken as a premise, the upper limit of the number density of Cu precipitates is substantially $50.0\times10^{21}/m^{21}/m^3$.

Accordingly, in the present embodiment, the number density of Cu precipitates is taken as ranging from $3.0\times10^{21}$ to $50.0\times10^{21}/m^3$. In the martensitic stainless steel material according to the present embodiment, a lower limit of the number density of Cu precipitates is preferably $3.2\times10^{21}/m^3$, and more preferably $3.5\times10^{21}/m^3$. On the other hand, as mentioned above, in the martensitic stainless steel material according to the present embodiment, the higher the upper limit of the number density of Cu precipitates is, the more preferable it is. However, the substantial upper limit of the number density of Cu precipitates changes depending on the Cu content in the steel material. Therefore, the upper limit of the number density of Cu precipitates, for example, may be $45.0\times10^{21}/m^3$, may be $40.0\times10^{21}/m^3$, or may be $35.0\times10^{21}/m^3$.

The number density of Cu precipitates in the martensitic stainless steel material according to the present embodiment can be determined by the following method. A thin film test specimen (with a thickness of 100 to 200 μm) for observation of Cu precipitates is prepared from the steel material according to the present embodiment. If the steel material is a steel plate, the thin film test specimen is prepared from a center portion of the plate thickness. If the steel material is a pipe, the thin film test specimen is prepared from a center portion of the wall thickness. If the steel material is a steel bar having a circular cross section, the thin film test specimen is prepared from an R/2 position. Note that, the thin film test specimen is prepared by electropolishing using a twin-jet method. Further, the size of the thin film test specimen is not particularly limited as long as an observation visual field to be described later is obtained.

An arbitrary four visual fields are identified on the observation surface of the obtained thin film test specimen. Although not particularly limited, the area of each visual field is, for example, 800 nm×800 nm. The identified four visual fields are subjected to microstructure observation using a transmission electron microscope (hereinafter, also referred to as "TEM"). The microstructure observation is conducted using an accelerating voltage of 200 kV and a diffraction condition set to a condition suitable for precipitate observation (for example, (200) two-beam condition). In addition, precipitates are photographed by performing exposure for an appropriate time.

Precipitates identified in the manner described above are subjected to elementary analysis by EDS. Note that, elements to be quantified set as Fe, Cr, Ni, Cu, Mn, Mo, and Si. Here, in the EDS, due to the characteristics of the apparatus, elementary analysis is performed with respect to a range that has a certain volume. In other words, even when precipitates are present at the observation surface, elementary analysis of only the precipitates cannot be performed, and the base material is also simultaneously subjected to elementary analysis. Accordingly, when elementary analysis by EDS is performed in a region in which Cu precipitates are present at the observation surface, elements (Fe and the like) derived from the base material are also simultaneously detected in addition to Cu.

On the other hand, in the present embodiment the Cu content in the base material is, as mentioned above, 0.50 to 3.50%. Therefore, in elementary analysis by EDS, when a precipitate has a Cu concentration of 15.0 mass % or more, it can be determined as being a Cu precipitate. In each observation visual field, the number of precipitates having a Cu concentration of 15.0 mass % or more (Cu precipitates) are counted. In addition, the volume ($m^3$) of each observation region is determined based on the area of each observation visual field and the thickness of the observation region. Note that, the thickness of the observation region can be determined based on, with respect to the thin film test specimen, the total integrated intensity of an electron energy loss spectrum (EELS) and the integrated intensity of a zero-loss spectrum.

The number density of Cu precipitates ($/m^3$) in each observation visual field is determined based on the obtained number of Cu precipitates in each observation visual field and the volume ($m^3$) of each observation visual field. The arithmetic average value of the number densities of Cu precipitates obtained in the four visual fields is defined as the number density of Cu precipitates ($/m^3$).

Note that, in the present embodiment the size of a Cu precipitate is not particularly limited. It suffices that a Cu precipitate is with a size that can be identified as a precipitate based on contrast in the method described above. Therefore, in the present embodiment, the size of a Cu precipitate is, for example, a size having an equivalent circle diameter of 1 to 100 nm. Note that, in the present description, the term "equivalent circular diameter" means the diameter of a circle in a case where the area of a precipitate observed on a visual field surface during microstructure observation is converted into a circle having the same area.

[Low-Temperature Toughness]

The martensitic stainless steel material according to the present embodiment has the above described chemical composition and the above described microstructure, and in addition, the number density of Cu precipitates in the martensitic stainless steel material is $3.0\times10^{21}$ to $50.0\times10^{21}/m^3$. As a result, even though the yield strength thereof is 125 ksi or more, the martensitic stainless steel material according to the present embodiment has the excellent low-temperature toughness in an extremely low-temperature environment and the excellent corrosion resistance. In the present embodiment, the excellent low-temperature toughness in an extremely low-temperature environment is defined as follows.

The low-temperature toughness of the martensitic stainless steel material according to the present embodiment can be evaluated by a Charpy impact test in conformity with ASTM E23 (2018). A V-notch test specimen is prepared from the steel material according to the present embodiment. Specifically, a V-notch test specimen is prepared in conformity with API SCRA (2010). The prepared V-notch test specimen is subjected to a Charpy impact test in conformity with ASTM E23 (2018) to determine absorbed energy E (−50° C.) (J) at −50° C. In the present embodiment, when the absorbed energy E (−50° C.) at −50° C. is 100 J or more, it is judged that the steel material according to the present embodiment has the excellent low-temperature toughness in an extremely low-temperature environment also. Note that, the absorbed energy E (−50° C.) (J) at −50° C. is obtained by rounding off the first decimal place of an obtained numerical value.

[Corrosion Resistance]

The martensitic stainless steel material according to the present embodiment has the above described chemical composition and the above described microstructure, and in addition, the number density of Cu precipitates in the martensitic stainless steel material is $3.0\times10^{21}$ to $50.0\times10^{21}/m^3$. As a result, even though the yield strength thereof is 125 ksi or more, the martensitic stainless steel material according to the present embodiment has the excellent low-temperature toughness in an extremely low-temperature environment and the excellent corrosion resistance. In the present embodiment, the excellent corrosion resistance is defined as follows.

The corrosion resistance of the martensitic stainless steel material according to the present embodiment can be evaluated by a method in conformity with NACE TM0177-2016 Method A. If the steel material according to the present embodiment is a steel plate, a round bar specimen is prepared from a center portion of the plate thickness. If the steel material according to the present embodiment is a pipe, a round bar specimen is prepared from a center portion of the wall thickness. If the steel material is a steel bar having a circular cross section, a round bar specimen is taken from an R/2 position. The size of the round bar specimen is, for example, as follows: the diameter is 6.35 mm and the length of a parallel portion is 25.4 mm. Note that, the axial direction of the round bar specimen is parallel with the rolling direction of the martensitic stainless steel material.

A mixed aqueous solution containing 20 mass % of sodium chloride and 0.41 g/L of sodium acetate to which acetic acid was added to adjust the pH to 4.0 is adopted as the test solution. A stress equivalent to 90% of the actual yield stress is applied to the round bar specimen. The test solution at 24° C. is poured into a test vessel so that the round bar test specimen to which the stress has been applied is immersed therein, and this is adopted as a test bath. After degassing the test bath, a mixed gas of $H_2S$ gas at 0.1 atm and $CO_2$ gas at 0.9 atm is blown into the test bath to cause the mixed gas to saturate in the test bath. The test bath in which the mixed gas saturated is held at 24° C. for 720 hours.

After being held for 720 hours, the round bar specimen is observed with the naked eye, a magnifying glass with a magnification of ×10, and an optical microscope with a magnification of ×100. If cracking is not confirmed in the round bar specimen as the result of the observation, the steel material according to the present embodiment is evaluated as having the excellent corrosion resistance. Note that, in the present description the phrase "cracking is not confirmed", means that cracking is not confirmed as a result of observing the test specimen after the test with the naked eye, with a magnifying glass with a magnification of ×10, and with an optical microscope with a magnification of ×100.

[Shape of Steel Material]

The shape of the martensitic stainless steel material according to the present embodiment is not particularly limited. The steel material is, for example, a pipe, a steel plate, or a steel bar. If the steel material is a pipe, a preferable wall thickness is 4 to 60 mm. More preferably, the martensitic stainless steel material according to the present embodiment is a seamless steel pipe. In a case where the martensitic stainless steel material according to the present embodiment is a seamless steel pipe, even if the wall thickness thereof is 15 mm or more, the martensitic stainless steel material has a yield strength of 862 MPa or more (125 ksi or more), the excellent low-temperature toughness in an extremely low-temperature environment, and the excellent corrosion resistance.

[Uses of Steel Material]

Uses of the martensitic stainless steel material according to the present embodiment are not particularly limited. The martensitic stainless steel material according to the present embodiment is suitable as a steel material for oil wells that is to be used in oil wells. The term "steel material for oil wells" refers to, for example, a steel bar for a downhole member, a line pipe, and oil country tubular goods. The term "oil country tubular goods" refers to, for example, a casing pipe, a tubing pipe, and a drilling pipe which are used for drilling of an oil well or a gas well, collection of crude oil or natural gas, and the like.

[Production Method]

An example of a method for producing the martensitic stainless steel material according to the present embodiment will now be described. In other words, the production method to be described below is an example, and a method for producing the martensitic stainless steel material of the present embodiment is not limited to the production method described below. In short, as long as the martensitic stainless steel material according to the present embodiment satisfies the requirements pertaining to the above described chemical composition, the above described microstructure, the above described yield strength, and the above described number density of Cu precipitates, the martensitic stainless steel material may be produced by another production method that is different from the production method described below. The method for producing the martensitic stainless steel material according to the present embodiment described below includes a process of preparing an intermediate steel material (preparation process), and a process of subjecting the prepared intermediate steel material to a heat treatment (heat treatment process). Each process is described in detail hereunder.

[Preparation Process]

In the preparation process, an intermediate steel material having the chemical composition described above is prepared. Here, in the present embodiment, the chemical composition of the intermediate steel material is the same as the chemical composition of the martensitic stainless steel material according to the present embodiment. Specifically, the intermediate steel material according to the present embodiment consists of, in mass %, C: less than 0.030%, Si: 1.00% or less, Mn: 0.05 to 2.00%, P: 0.050% or less, S: 0.0050% or less, Cr: 11.50 to 14.00%, Ni: 5.00 to 7.50%, Mo: 1.10 to 3.50%, Cu: 0.50 to 3.50%, Co: 0.01 to 0.30%, Al: 0.001 to 0.100%, N: 0.001 to 0.100%, O: 0.010% or less, W: 0 to 2.00%, V: 0 to 0.300%, Ti: 0 to 0.300%, Nb: 0 to 0.300%, Ca: 0 to 0.0100%, Mg: 0 to 0.0100%, rare earth metal: 0 to 0.100%, B: 0 to 0.0100%, and the balance: Fe and impurities. The production method is not particularly limited as long as the intermediate steel material has the above described chemical composition. As used here, the term "intermediate steel material" refers to, for example, a plate-shaped steel material in a case where the end product is a steel plate, refers to a hollow shell in a case where the end product is a seamless steel pipe, and refers to a bar-shaped steel material in a case where the end product is a steel bar. Preferably, the preparation process according to the present embodiment includes a starting material preparation process and a hot working process. Hereunder, a case where the preparation process includes a starting material preparation process and a hot working process will be described in detail.

[Starting Material Preparation Process]

In the starting material preparation process, a starting material having the above described chemical composition is prepared. The starting material may be prepared by producing the starting material, or may be prepared by purchasing the starting material from a third party. In other words, the method for preparing the starting material is not particularly limited. In the case of producing the starting material, for example, the starting material is produced by the following method. Molten steel having the above described chemical composition is produced by a well-known method. The produced molten steel is used to produce a cast piece through a continuous casting process. Here, the cast piece is a slab, a bloom, or a billet. In place of the cast piece, an ingot may be produced by an ingot-making process using the above described molten steel. As needed, the slab, the bloom, or the ingot may be subjected to hot rolling to produce a billet. The starting material (slab, bloom, or billet) is produced by the above described production process. Hereunder, the hot working process is described in detail.

[Hot Working Process]

In the hot working process the starting material prepared in the aforementioned preparation process is subjected to hot working to produce an intermediate steel material. The method of hot working for producing the intermediate steel material is not particularly limited. In other words, in the present embodiment the hot working may be hot forging, may be hot extrusion, or may be hot rolling.

If the steel material is a seamless steel pipe, the starting material is subjected to hot working to produce a hollow shell (seamless hollow shell). In this case, as hot working, for example, the Ugine-Sejournet process or the Ehrhardt push bench process (that is, hot extrusion) may be performed. In a case where the intermediate steel material is a seamless steel pipe, furthermore, as hot working, for example, piercing-rolling (that is, hot rolling) according to the Mannesmann process may be performed.

For example, in the case of performing piercing-rolling according to the Mannesmann process in the hot working, the piercing-rolling can be performed by the following method. First, the starting material is heated in a heating furnace. The heating temperature is, although not particularly limited, for example, 1100 to 1300° C. The starting material extracted from the heating furnace is subjected to piercing-rolling to produce an intermediate steel material (hollow shell). When performing piercing-rolling, the piercing ratio is, although not particularly limited, for example, 1.0 to 4.0. The billet after piercing-rolling is subjected to drawing and rolling using a mandrel mill. As needed, the billet after drawing and rolling is further subjected to diameter adjusting rolling using a reducer or a sizing mill. The hollow shell is produced by the above described processes. A cumulative reduction of area in the hot working process is, although not particularly limited, for example. 20 to 70%.

If the steel material is a steel bar, the starting material is subjected to hot working to produce an intermediate steel material (steel bar). In this case, as hot working, blooming may be performed, or hot rolling may be performed. When performing blooming or hot rolling, although not particularly limited, the heating temperature is, for example, 1100 to 1300° C. When performing hot rolling, preferably the hot rolling is performed by a continuous mill. In a continuous mill, a horizontal stand having a pair of grooved rolls arranged one on the other in the vertical direction, and a vertical stand having a pair of grooved rolls arranged side by side in the horizontal direction are alternately arranged.

If the steel material is a steel plate, the starting material is subjected to hot working to produce an intermediate steel material (plate-shaped steel material). In this case, as hot working, blooming may be performed, or hot rolling may be performed. When performing blooming or hot rolling, although not particularly limited, the heating temperature is, for example, 1100 to 1300° C. The starting material extracted from the heating furnace is subjected to hot rolling using a blooming mill and a continuous mill to produce an intermediate steel material (plate-shaped steel material).

As described above, an intermediate steel material having a desired shape is produced by the hot working process. Note that hot working may be performed only one time or may be performed multiple times. For example, after performing the aforementioned piercing-rolling on the starting material, the aforementioned hot extrusion may be performed. Furthermore, for example, after subjecting the starting material to the aforementioned blooming, hot rolling using the aforementioned continuous mill may be performed.

The intermediate steel material produced by hot working may be air-cooled (as-rolled). The intermediate steel material produced by hot working may also be subjected to direct quenching after hot working without being cooled to normal temperature, or may be subjected to quenching after undergoing supplementary heating (reheating) after hot working. In a case where direct quenching is performed after hot working, or quenching is performed after performing supplementary heating after hot working, for the purpose of eliminating residual stress, stress relief annealing (SR treatment) may be performed before a heat treatment process (quenching and tempering) of the next process.

As described above, an intermediate steel material is prepared in the preparation process. The intermediate steel material may be produced by the aforementioned preferable process, or may be an intermediate steel material produced by a third party, or may be an intermediate steel material produced in another factory other than the factory in which a heat treatment process to be described later is performed, or may be an intermediate steel material produced at a different works. Hereunder, the heat treatment process is described in detail.

[Heat Treatment Process]

The heat treatment process includes a quenching process and a tempering process. In other words, in the heat treatment process, the intermediate steel material prepared by the preparation process is subjected to quenching (a quenching process). The intermediate steel material subjected to quenching is then subjected to tempering (a tempering process). Hereunder, the quenching process and the tempering process are each described in detail.

[Quenching Process]

In the quenching process, the intermediate steel material prepared by the preparation process is subjected to quenching. As used in the present description, the term "quenching" means rapidly cooling the intermediate steel material which is at a temperature not lower than the $A_{c3}$ transformation point. A preferable quenching temperature is 800 to 1000° C. In other words, in the quenching process of the present embodiment, quenching is performed by rapidly cooling the intermediate steel material which is at a temperature of 800 to 1000° C. Note that in a case where direct quenching is performed after hot working, the quenching temperature corresponds to the surface temperature of the intermediate steel material that is measured by a thermometer placed on the exit side of the apparatus that performs the final hot working. Further, in a case where quenching is performed using a supplementary heating furnace or a heat treatment furnace after hot working, the quenching temperature corresponds to the temperature of the supplementary heating furnace or the heat treatment furnace.

In the case of performing quenching using a supplementary heating furnace or a heat treatment furnace after hot working, the time for which the intermediate steel material is held in the supplementary heating furnace or heat treatment furnace is not particularly limited, and for example is 10 to 60 minutes. In this case, the phrase "time for which the intermediate steel material is held in the supplementary heating furnace or heat treatment furnace" means an in-furnace time (the time from loading the intermediate steel material into the heat treatment furnace or the supplementary heating furnace until extracting the intermediate steel material therefrom).

The quenching method may be a well-known method, and is not particularly limited. The quenching method, for example, is a method that continuously cools the intermediate steel material from the quenching starting temperature, and continuously decreases the temperature of the intermediate steel material. For example, the intermediate steel material may be cooled by being immersed in a water bath, or the intermediate steel material may be subjected to accelerated cooled by shower water cooling or mist cooling. According to these methods, during quenching, the cooling rate when the temperature of the intermediate steel material is in the range of 800 to 500° C. is 8° C./sec or more. As a result, in the microstructure of the intermediate steel material after quenching, the volume ratio of martensite is 75% or more, the volume ratio of retained austenite is 15% or less and, furthermore, the volume ratio of ferrite is 10% or less. Note that, subjecting the intermediate steel material having the above described chemical composition which is at a temperature of 800 to 1000° C. to quenching to thereby cause the intermediate steel material to have the aforementioned microstructure is something that those skilled in the art can carry out as a matter of course.

[Tempering Process]

In the tempering process, the quenched intermediate steel material is subjected to tempering. In the present description, the term "tempering" means reheating the intermediate steel material after quenching to a temperature that is not more than the $A_{c1}$ point and holding the intermediate steel material at that temperature. The tempering temperature is appropriately adjusted in accordance with the chemical composition of the steel material and the yield strength to be obtained. In other words, with respect to the intermediate steel material having the chemical composition of the present embodiment, the tempering temperature is adjusted so as to adjust the yield strength of the steel material to 862 MPa or more (125 ksi or more). Here, the tempering temperature corresponds to the temperature of the furnace when the intermediate steel material after quenching is heated and held. The term "tempering time" means the in-furnace time (the time from loading the intermediate steel material into the heat treatment furnace until extracting the intermediate steel material therefrom).

As mentioned above, in the martensitic stainless steel material according to the present embodiment, a large amount of Cu precipitates are caused to precipitate in the steel material. In addition, in the production method of the present embodiment, the intermediate steel material is subjected to quenching as described above. Therefore, in the intermediate steel material after quenching, most of the Cu is dissolved in the intermediate steel material. Accordingly, when Cu precipitates can be caused to finely precipitate in the intermediate steel material by tempering, the number density of Cu precipitates in the martensitic stainless steel material after tempering can be increased.

Therefore, the present inventors conducted a detailed investigation and study regarding a technique for causing a large number of fine Cu precipitates to precipitate by performing tempering. As a result, the present inventors discovered that by performing tempering in two stages that include a tempering process of holding the intermediate steel material at a comparatively low temperature and a tempering process of holding the intermediate steel material at a high temperature, the number density of Cu precipitates is increased. With regard to the reason why the number density of Cu precipitates of the martensitic stainless steel material is increased by tempering that is performed in two stages, the present inventors consider that the reason is as follows.

When attempting to obtain a martensitic stainless steel material having a yield strength of 125 ksi or more by subjecting an intermediate steel material having the above described chemical composition to tempering, the tempering temperature is set to 555 to 650° C., and the tempering time is set to 10 to 180 minutes. Here, in a case where tempering is performed in the temperature range of 555 to 650° C., there is a possibility that, among the Cu precipitates, mainly Cu precipitates having a face-centered cubic structure (hereinafter, also referred to as "ε-Cu") precipitate. It is considered that among Cu precipitates, the energy state of ε-Cu is low and ε-Cu is thermodynamically stable. However, in the case of an intermediate steel material having the above described chemical composition, the microstructure of the intermediate steel material after quenching is mainly composed of martensite that has a body-centered cubic structure. Therefore, in the case of s-Cu which has a face-centered cubic structure, the affinity of the crystal structure with a surrounding martensite phase is low. In other words, it is surmised that when holding in a temperature range in which it is easy for ε-Cu to precipitate, it is easier for s-Cu to grow coarsely than for the number of precipitation nuclei to increase. Thus, it is surmised that when tempering is performed so as to obtain a martensitic stainless steel material having a yield strength of 125 ksi or more, coarse Cu precipitates are precipitated.

On the other hand, in a case where an intermediate steel material having the above described chemical composition is subjected to tempering in which the tempering temperature is set to 500 to 545° C., there is a possibility that, among the Cu precipitates, Cu precipitates having a metastable body-centered cubic structure (hereunder, also referred to as "bcc-Cu") mainly precipitate. In comparison to ε-Cu, the energy state of bcc-Cu is high and, thermodynamically, the stability is low. However, in the case of bcc-Cu, the affinity of the crystal structure with a surrounding martensite phase is high. Therefore, it is surmised that when holding in a temperature range in which it is easy for bcc-Cu to precipitate, it is easier for the number of precipitation nuclei to increase than for bcc-Cu to grow coarsely due to diffusion of Cu. Therefore, there is a possibility that by causing bcc-Cu to precipitate in the intermediate steel material, Cu precipitates can be finely dispersed in the intermediate steel material.

However, as mentioned above, the intermediate steel material having the above described chemical composition is subjected to tempering, and the tempering temperature is set to 555 to 650° C. in order to make the yield strength of the steel material after tempering 125 ksi or more. Therefore, in a case where the tempering temperature is lowered to 500 to 545° C. for the purpose of causing bcc-Cu to precipitate, the tempering temperature is too low and therefore the yield strength will become too high. In this case, the low-temperature toughness and the corrosion resistance of the steel material after tempering decrease. Therefore, in the tempering process according to the present embodiment, after performing a first tempering process in which the tempering temperature is set to 500 to 545° C., a second tempering process in which the tempering temperature is set to 555 to 650° C. is performed. According to this tempering process performed in two stages, in the first tempering process a large number of bcc-Cu precipitate and the number density of Cu precipitates increases. It is considered that thereafter, in the second tempering process, the yield strength of the steel material can be adjusted to 125 ksi or more. Note that, it is predicted that a major portion of the bcc-Cu will transform to ε-Cu in the second tempering process.

As described above, according to the above described first tempering process and second tempering process, in the steel material after tempering, the number density of Cu precipitates can be made $3.0\times10^{21}$ to $50.0\times10^{21}/m^3$ and a yield strength of 125 ksi or more can be obtained. Note that, there is also a possibility that the number density of Cu precipitates in the steel material according to the present embodiment is increased by a mechanism other than the mechanism described above. However, it has been demonstrated as described in EXAMPLE below that the number density of Cu precipitates in the steel material after tempering is made $3.0\times10^{21}$ to $50.0\times10^{21}/m^3$ and a yield strength of 125 ksi or more is obtained according to the tempering process carried out over the aforementioned two stages. Hereunder, the first tempering process and the second tempering process are described in detail.

[First Tempering Process]

In the first tempering process, the quenched intermediate steel material is heated and subjected to tempering at a tempering temperature of 500 to 545° C. for a tempering time of 5 to 60 minutes. If the tempering temperature in the first tempering process is too low, bcc-Cu will not sufficiently precipitate during the tempering of the first tempering process. In this case, in the steel material after the second tempering process that is described later, the number density of Cu precipitates will decrease, and the low-temperature toughness of the steel material will decrease. On the other hand, if the tempering temperature in the first tempering process is too high, ε-Cu will precipitate and coarsen during the tempering of the first tempering process. As a result, the number density of Cu precipitates will decrease, and the low-temperature toughness of the steel material will decrease.

Therefore, in the first tempering process according to the present embodiment, the tempering temperature is 500 to 545° C. An upper limit of the tempering temperature in the first tempering process is preferably 540° C. A lower limit of the tempering temperature in the first tempering process is preferably 510° C.

If the tempering time in the first tempering process is too short, bcc-Cu will not sufficiently precipitate during the tempering of the first tempering process. In this case, in the steel material after the second tempering process that is described later, the number density of Cu precipitates will decrease, and the low-temperature toughness of the steel material will decrease. On the other hand, even when the tempering time in the first tempering process is too long, the aforementioned effect will be saturated. Therefore, in the first tempering process according to the present embodiment, the tempering time is to be 5 to 60 minutes.

[Second Tempering Process]

In the second tempering process, the quenched intermediate steel material is heated and subjected to tempering at a tempering temperature of 555 to 650° C. for a tempering time of 10 to 90 minutes. If the tempering temperature in the second tempering process is too low, the yield strength of the steel material will become too high and the low-temperature toughness of the steel material will decrease. On the other hand, if the tempering temperature in the second tempering process is too high, the yield strength of the steel material will become too low and a yield strength of 125 ksi or more will not be obtained.

Therefore, in the second tempering process according to the present embodiment, the tempering temperature is 555 to 650° C. An upper limit of the tempering temperature in the second tempering process is preferably 630° C. A lower limit of the tempering temperature in the second tempering process is preferably 560° C.

If the tempering time in the second tempering process is too short, the tempering will be insufficient and the yield strength of the steel material will become too high, and the low-temperature toughness of the steel material will decrease. On the other hand, even when the tempering time in the second tempering process is too long, the aforementioned effect will be saturated. Therefore, in the second tempering process according to the present embodiment, the tempering time is to be 10 to 90 minutes.

Note that, the aforementioned first tempering process and second tempering process can be performed as consecutive heat treatments. In other words, after performing the aforementioned tempering in the first tempering process, next, the second tempering process may be performed in a successive manner by heating the intermediate steel material. At this time, the first tempering process and the second tempering process may be performed within the same heat treatment furnace.

On the other hand, the aforementioned first tempering process and second tempering process can also be performed as non-consecutive heat treatments. In other words, after performing the aforementioned tempering in the first tempering process, the intermediate steel material may be temporarily cooled to a lower temperature than the aforementioned tempering temperature, and thereafter heated again to perform the second tempering process. Even in this case, the effects obtained by the first tempering process and the second tempering process are not impaired, and the steel material according to the present embodiment can be produced.

The martensitic stainless steel material according to the present embodiment can be produced by the production method that is described above. Note that, the production method described above is a description of one example of a method for producing the martensitic stainless steel material according to the present embodiment. In other words, the martensitic stainless steel material according to the present embodiment may be produced by a production method other than the production method that is described above. Even in such a case, a martensitic stainless steel material having the above described chemical composition, the above described microstructure, and the aforementioned number density of Cu precipitates has a yield strength of 125 ksi or more, the excellent low-temperature toughness, and the excellent corrosion resistance. In other words, the method for producing the martensitic stainless steel material according to the present embodiment is not limited to the production method that is described above, and the martensitic stainless steel material may also be produced by another production method. Hereunder, the martensitic stainless steel material according to the present embodiment is described more specifically by way of an example.

Example

Molten steels having the chemical compositions shown in Table 1 were melted using a 50 kg vacuum melting furnace, and ingots were produced by an ingot-making process. Note that the symbol "-" in Table 1 means that the content of the corresponding element was at an impurity level. For example, it means that the W content of Test No. 1 was 0% when rounded off to two decimal places. In addition, for example, it means that the V content, Ti content, Nb content, and REM content of Test No. 1 were each 0% when rounded off to three decimal places. Further, for example, it means that the Ca content, Mg content, and B content of Test No. 1 were each 0% when rounded off to four decimal places. Furthermore, for example, it means that the Co content of Test No. 44 was 0% when rounded off to two decimal places.

TABLE 1

| Test | Chemical composition (in mass %, balance being Fe and impurities) | | | | | | | | | | |
|---|---|---|---|---|---|---|---|---|---|---|---|
| No. | C | Si | Mn | P | S | Cr | Ni | Mo | Cu | Co | Al |
| 1 | 0.005 | 0.07 | 0.48 | 0.028 | 0.0001 | 11.98 | 6.43 | 2.91 | 2.29 | 0.08 | 0.020 |
| 2 | 0.006 | 0.13 | 0.44 | 0.002 | 0.0007 | 13.64 | 5.66 | 2.91 | 1.80 | 0.16 | 0.011 |
| 3 | 0.009 | 0.27 | 0.30 | 0.005 | 0.0003 | 13.42 | 5.36 | 2.66 | 1.80 | 0.12 | 0.021 |
| 4 | 0.006 | 0.21 | 0.48 | 0.018 | 0.0006 | 11.78 | 7.20 | 2.13 | 2.05 | 0.02 | 0.010 |
| 5 | 0.007 | 0.30 | 0.22 | 0.023 | 0.0001 | 13.38 | 7.08 | 1.49 | 1.84 | 0.19 | 0.022 |
| 6 | 0.006 | 0.05 | 0.33 | 0.024 | 0.0001 | 11.54 | 7.13 | 3.16 | 1.40 | 0.24 | 0.023 |
| 7 | 0.007 | 0.40 | 0.80 | 0.023 | 0.0003 | 13.38 | 5.38 | 2.21 | 1.05 | 0.18 | 0.012 |
| 8 | 0.006 | 0.49 | 0.44 | 0.025 | 0.0001 | 12.35 | 5.92 | 2.21 | 2.98 | 0.26 | 0.024 |
| 9 | 0.007 | 0.29 | 0.64 | 0.019 | 0.0005 | 13.14 | 6.19 | 1.86 | 2.47 | 0.02 | 0.012 |
| 10 | 0.006 | 0.02 | 0.70 | 0.013 | 0.0004 | 11.74 | 5.86 | 2.33 | 2.30 | 0.02 | 0.020 |
| 11 | 0.007 | 0.13 | 0.23 | 0.012 | 0.0003 | 13.20 | 6.50 | 3.20 | 1.10 | 0.11 | 0.015 |
| 12 | 0.007 | 0.01 | 0.22 | 0.013 | 0.0007 | 13.10 | 6.20 | 2.90 | 1.30 | 0.12 | 0.020 |
| 13 | 0.007 | 0.48 | 0.18 | 0.014 | 0.0004 | 13.20 | 5.70 | 3.00 | 1.25 | 0.17 | 0.019 |
| 14 | 0.009 | 0.22 | 0.44 | 0.007 | 0.0002 | 12.90 | 6.90 | 1.80 | 1.57 | 0.09 | 0.021 |
| 15 | 0.006 | 0.31 | 0.59 | 0.010 | 0.0007 | 12.65 | 5.80 | 3.11 | 2.62 | 0.08 | 0.028 |
| 16 | 0.006 | 0.18 | 0.38 | 0.025 | 0.0003 | 13.28 | 5.45 | 1.98 | 2.45 | 0.08 | 0.016 |
| 17 | 0.009 | 0.45 | 0.15 | 0.002 | 0.0001 | 12.45 | 6.53 | 2.89 | 2.88 | 0.09 | 0.019 |
| 18 | 0.008 | 0.15 | 0.18 | 0.007 | 0.0005 | 12.93 | 6.22 | 2.65 | 1.99 | 0.09 | 0.030 |
| 19 | 0.009 | 0.22 | 0.44 | 0.007 | 0.0002 | 12.94 | 6.91 | 2.33 | 1.57 | 0.09 | 0.020 |
| 20 | 0.007 | 0.17 | 0.35 | 0.001 | 0.0008 | 11.64 | 5.56 | 2.48 | 2.43 | 0.10 | 0.022 |
| 21 | 0.006 | 0.26 | 0.55 | 0.012 | 0.0008 | 13.53 | 6.67 | 3.10 | 1.45 | 0.10 | 0.019 |
| 22 | 0.006 | 0.33 | 0.39 | 0.007 | 0.0003 | 12.43 | 6.40 | 2.83 | 1.61 | 0.11 | 0.024 |
| 23 | 0.007 | 0.29 | 0.21 | 0.012 | 0.0007 | 12.81 | 6.08 | 2.85 | 1.71 | 0.13 | 0.020 |
| 24 | 0.009 | 0.19 | 0.24 | 0.017 | 0.0005 | 12.81 | 5.96 | 2.18 | 2.15 | 0.15 | 0.011 |
| 25 | 0.005 | 0.12 | 0.65 | 0.015 | 0.0003 | 13.32 | 5.79 | 3.12 | 1.37 | 0.16 | 0.020 |
| 26 | 0.007 | 0.45 | 0.48 | 0.019 | 0.0001 | 12.39 | 5.77 | 2.86 | 2.85 | 0.17 | 0.012 |
| 27 | 0.007 | 0.12 | 0.46 | 0.011 | 0.0006 | 12.05 | 5.53 | 1.93 | 2.96 | 0.18 | 0.027 |
| 28 | 0.006 | 0.11 | 0.50 | 0.030 | 0.0005 | 12.74 | 6.59 | 2.34 | 2.07 | 0.19 | 0.026 |
| 29 | 0.006 | 0.23 | 0.73 | 0.014 | 0.0002 | 12.16 | 6.69 | 2.61 | 1.91 | 0.19 | 0.021 |
| 30 | 0.006 | 0.29 | 0.33 | 0.001 | 0.0007 | 12.15 | 6.31 | 3.08 | 1.81 | 0.19 | 0.023 |
| 31 | 0.006 | 0.04 | 0.74 | 0.017 | 0.0007 | 13.46 | 6.27 | 2.50 | 1.78 | 0.19 | 0.025 |
| 32 | 1.007 | 0.45 | 0.24 | 0.021 | 0.0007 | 13.20 | 6.40 | 3.20 | 2.25 | 0.16 | 0.023 |
| 33 | 0.007 | 0.44 | 0.37 | 0.021 | 0.0005 | 13.30 | 6.90 | 1.60 | 2.88 | 0.03 | 0.017 |
| 34 | 0.007 | 0.45 | 0.48 | 0.019 | 0.0001 | 12.40 | 5.80 | 2.90 | 2.85 | 0.17 | 0.019 |
| 35 | 0.030 | 0.20 | 0.79 | 0.029 | 0.0001 | 11.52 | 6.34 | 3.04 | 1.28 | 0.22 | 0.018 |
| 36 | 0.006 | 0.21 | 0.11 | 0.025 | 0.0003 | 11.16 | 6.89 | 2.05 | 1.64 | 0.27 | 0.011 |
| 37 | 0.006 | 0.04 | 0.35 | 0.020 | 0.0005 | 14.19 | 5.79 | 2.00 | 1.06 | 0.27 | 0.029 |
| 38 | 0.009 | 0.40 | 0.40 | 0.013 | 0.0005 | 13.04 | 4.83 | 2.08 | 2.40 | 0.29 | 0.016 |
| 39 | 0.006 | 0.42 | 0.48 | 0.019 | 0.0002 | 12.13 | 7.73 | 1.81 | 1.33 | 0.23 | 0.027 |
| 40 | 0.007 | 0.27 | 0.45 | 0.021 | 0.0007 | 11.98 | 7.00 | 0.72 | 1.16 | 0.07 | 0.027 |
| 41 | 0.005 | 0.36 | 0.57 | 0.027 | 0.0007 | 12.38 | 5.70 | 3.64 | 1.28 | 0.15 | 0.021 |
| 42 | 0.009 | 0.36 | 0.36 | 0.009 | 0.0005 | 11.80 | 6.21 | 2.13 | 0.40 | 0.11 | 0.019 |
| 43 | 0.008 | 0.06 | 0.72 | 0.004 | 0.0001 | 12.74 | 5.60 | 2.64 | 3.62 | 0.28 | 0.022 |
| 44 | 0.007 | 0.08 | 0.50 | 0.025 | 0.0003 | 12.90 | 6.60 | 2.60 | 1.18 | — | 0.018 |
| 45 | 0.006 | 0.09 | 0.16 | 0.024 | 0.0002 | 13.51 | 6.73 | 2.53 | 1.35 | 0.03 | 0.011 |
| 46 | 0.007 | 0.01 | 0.52 | 0.013 | 0.0007 | 12.19 | 5.98 | 2.29 | 1.56 | 0.29 | 0.013 |
| 47 | 0.007 | 0.06 | 0.25 | 0.010 | 0.0001 | 12.30 | 6.27 | 3.17 | 2.54 | 0.05 | 0.021 |

| Test | Chemical composition (in mass %, balance being Fe and impurities) | | | | | | | | | |
|---|---|---|---|---|---|---|---|---|---|---|
| No. | N | O | W | V | Ti | Nb | Ca | Mg | REM | B |
| 1 | 0.006 | 0.005 | — | — | — | — | — | — | — | — |
| 2 | 0.001 | 0.008 | — | — | — | — | — | — | — | — |
| 3 | 0.004 | 0.007 | — | — | — | — | — | — | — | — |
| 4 | 0.006 | 0.004 | — | — | — | — | — | — | — | — |
| 5 | 0.004 | 0.010 | — | — | — | — | — | — | — | — |
| 6 | 0.001 | 0.002 | — | — | — | — | — | — | — | — |
| 7 | 0.005 | 0.010 | — | — | — | — | — | — | — | — |
| 8 | 0.008 | 0.005 | — | — | — | — | — | — | — | — |
| 9 | 0.004 | 0.002 | — | — | — | — | — | — | — | — |
| 10 | 0.007 | 0.007 | — | — | — | — | — | — | — | — |
| 11 | 0.008 | 0.005 | — | — | — | — | — | — | — | — |
| 12 | 0.006 | 0.003 | — | — | — | — | — | — | — | — |
| 13 | 0.007 | 0.007 | — | — | — | — | — | — | — | — |
| 14 | 0.006 | 0.004 | 0.12 | — | — | — | — | — | — | — |
| 15 | 0.007 | 0.008 | — | 0.035 | — | — | — | — | — | — |
| 16 | 0.004 | 0.010 | — | — | 0.035 | — | — | — | — | — |
| 17 | 0.001 | 0.005 | — | — | — | 0.067 | — | — | — | — |
| 18 | 0.005 | 0.001 | — | 0.056 | 0.045 | — | — | — | — | — |
| 19 | 0.008 | 0.008 | 0.12 | — | 0.069 | — | — | — | — | — |
| 20 | 0.001 | 0.007 | 0.21 | — | 0.082 | 0.044 | — | — | — | — |
| 21 | 0.001 | 0.005 | — | — | — | — | 0.0027 | — | — | — |
| 22 | 0.008 | 0.007 | — | — | — | — | — | 0.0096 | — | — |
| 23 | 0.007 | 0.004 | — | — | — | — | — | — | 0.034 | — |
| 24 | 0.005 | 0.003 | — | — | — | — | — | — | — | 0.0008 |

TABLE 1-continued

| | | | | | | | | | | |
|---|---|---|---|---|---|---|---|---|---|---|
| 25 | 0.008 | 0.002 | — | — | — | — | 0.0048 | — | — | 0.0008 |
| 26 | 0.008 | 0.007 | — | — | — | — | — | 0.0024 | 0.074 | — |
| 27 | 0.001 | 0.004 | 0.21 | — | — | — | 0.0077 | — | — | — |
| 28 | 0.007 | 0.007 | 0.02 | — | — | — | — | 0.0055 | — | 0.0022 |
| 29 | 0.001 | 0.004 | — | 0.168 | — | — | 0.0098 | — | — | — |
| 30 | 0.005 | 0.002 | — | — | 0.055 | — | — | 0.0067 | — | — |
| 31 | 0.007 | 0.010 | 0.26 | — | 0.028 | — | 0.0015 | — | — | — |
| 32 | 0.004 | 0.002 | — | — | — | — | — | — | — | — |
| 33 | 0.005 | 0.001 | — | — | — | — | — | — | — | — |
| 34 | 0.003 | 0.003 | — | — | — | — | — | — | — | — |
| 35 | 0.005 | 0.009 | — | — | — | — | — | — | — | — |
| 36 | 0.003 | 0.003 | — | — | — | — | — | — | — | — |
| 37 | 0.002 | 0.001 | — | — | — | — | — | — | — | — |
| 38 | 0.002 | 0.005 | — | — | — | — | — | — | — | — |
| 39 | 0.006 | 0.009 | — | — | — | — | — | — | — | — |
| 40 | 0.003 | 0.006 | — | — | — | — | — | — | — | — |
| 41 | 0.008 | 0.006 | — | — | — | — | — | — | — | — |
| 42 | 0.004 | 0.003 | — | — | — | — | — | — | — | — |
| 43 | 0.008 | 0.007 | — | — | — | — | — | — | — | — |
| 44 | 0.005 | 0.004 | — | — | — | — | — | — | — | — |
| 45 | 0.001 | 0.003 | — | — | — | — | — | — | — | — |
| 46 | 0.005 | 0.004 | — | — | — | — | — | — | — | — |
| 47 | 0.008 | 0.001 | — | — | — | — | — | — | — | — |

The ingot of each test number was heated at 1250° C. for three hours, and then subjected to bot forging to produce a block. The block of each test number after hot forging was heated at 1230° C. for 15 minutes and subjected to hot rolling. In this manner, intermediate steel materials (plate materials) having a plate thickness of 13 mm were produced.

For the intermediate steel material of each test number, quenching was performed. Specifically, the intermediate steel material of each test number was heated in a heat treatment furnace held at 900° C., and thereafter was cooled by performing water cooling. Note that, for the intermediate steel material of each test number, the in-furnace time in the heat treatment furnace was 15 minutes.

The quenched intermediate steel material of each test number was subjected to tempering to produce a steel material (plate material) of each test number. Specifically, a first tempering process and a second tempering process were performed in a consecutive manner on the intermediate steel material of each test number. For each test number, the tempering temperature (temperature of tempering furnace) in the first tempering process is represented as "T1 (° C.)", the tempering time (in-furnace time) in the first tempering process is represented as "t1 (min)", the tempering temperature (temperature of tempering furnace) in the second tempering process is represented as "T2 (° C.)", and the tempering time (in-furnace time) in the second tempering process is represented as "t2 (min)", and each of these values is shown in Table 2.

[Table 2]

TABLE 2

| | Tempering conditions | | | | Microstructure | | Cu precipitates | | E | Corrosion |
|---|---|---|---|---|---|---|---|---|---|---|
| Test No. | T1 (° C.) | t1 (min) | T2 (° C.) | t2 (min) | Retained γ (%) | Ferrite (%) | number density ($\times 10^{21}$ /m$^3$) | YS (MPa) | (−50° C.) (J) | resistance test |
| 1 | 540 | 30 | 600 | 35 | 8 | 0 | 5.0 | 943 | 142 | E |
| 2 | 540 | 30 | 600 | 35 | 3 | 0 | 3.9 | 928 | 147 | E |
| 3 | 530 | 30 | 590 | 35 | 2 | 0 | 6.8 | 953 | 141 | E |
| 4 | 540 | 30 | 580 | 35 | 11 | 0 | 13.3 | 951 | 152 | E |
| 5 | 520 | 30 | 560 | 35 | 10 | 0 | 35.6 | 955 | 139 | E |
| 6 | 530 | 30 | 590 | 35 | 13 | 0 | 5.3 | 949 | 115 | E |
| 7 | 520 | 30 | 560 | 35 | 2 | 0 | 20.3 | 952 | 136 | E |
| 8 | 540 | 30 | 600 | 35 | 5 | 0 | 6.5 | 947 | 149 | E |
| 9 | 530 | 30 | 590 | 35 | 6 | 0 | 9.3 | 946 | 136 | E |
| 10 | 530 | 30 | 590 | 35 | 4 | 0 | 8.6 | 956 | 114 | E |
| 11 | 540 | 30 | 580 | 35 | 7 | 10 | 7.1 | 868 | 102 | E |
| 12 | 540 | 30 | 580 | 35 | 5 | 6 | 8.4 | 900 | 103 | E |
| 13 | 540 | 30 | 580 | 35 | 3 | 2 | 8.1 | 941 | 102 | E |
| 14 | 520 | 30 | 560 | 35 | 9 | 0 | 17.6 | 955 | 121 | E |
| 15 | 530 | 30 | 610 | 35 | 5 | 0 | 3.7 | 936 | 147 | E |
| 16 | 530 | 30 | 590 | 35 | 3 | 0 | 9.2 | 952 | 114 | E |
| 17 | 530 | 30 | 610 | 35 | 3 | 0 | 3.6 | 938 | 128 | E |
| 18 | 530 | 30 | 590 | 35 | 5 | 0 | 7.5 | 959 | 115 | E |
| 19 | 530 | 30 | 570 | 35 | 9 | 0 | 17.6 | 961 | 128 | E |
| 20 | 540 | 30 | 600 | 35 | 3 | 0 | 5.3 | 931 | 114 | E |
| 21 | 530 | 30 | 590 | 35 | 9 | 0 | 5.4 | 956 | 117 | E |
| 22 | 530 | 30 | 590 | 35 | 7 | 0 | 6.0 | 947 | 140 | E |
| 23 | 530 | 30 | 590 | 35 | 5 | 0 | 6.4 | 955 | 141 | E |
| 24 | 540 | 30 | 580 | 35 | 4 | 0 | 13.9 | 964 | 127 | E |
| 25 | 530 | 30 | 590 | 35 | 4 | 0 | 5.1 | 953 | 144 | E |
| 26 | 530 | 30 | 610 | 35 | 5 | 0 | 3.6 | 934 | 118 | E |

TABLE 2-continued

| Test No. | Tempering conditions T1 (° C.) | t1 (min) | T2 (° C.) | t2 (min) | Microstructure Retained γ (%) | Ferrite (%) | Cu precipitates number density ($\times 10^{21}$ /m$^3$) | YS (MPa) | E (−50° C.) (J) | Corrosion resistance test |
|---|---|---|---|---|---|---|---|---|---|---|
| 27 | 540 | 30 | 600 | 35 | 3 | 0 | 6.4 | 933 | 119 | E |
| 28 | 530 | 30 | 590 | 35 | 8 | 0 | 7.8 | 948 | 151 | E |
| 29 | 530 | 30 | 590 | 35 | 9 | 0 | 7.2 | 950 | 123 | E |
| 30 | 540 | 30 | 600 | 35 | 7 | 0 | 3.9 | 930 | 123 | E |
| 31 | 540 | 30 | 580 | 35 | 6 | 0 | 11.5 | 963 | 121 | E |
| 32 | 540 | 30 | 580 | 35 | 6 | 0 | 8.4 | 991 | 139 | E |
| 33 | 530 | 30 | 570 | 35 | 5 | 0 | 18.7 | 1017 | 127 | E |
| 34 | 530 | 30 | 570 | 35 | 5 | 0 | 18.5 | 1049 | 106 | E |
| 35 | 540 | 30 | 580 | 35 | 6 | 0 | 8.3 | 957 | 148 | NA |
| 36 | 520 | 30 | 560 | 35 | 10 | 0 | 31.8 | 964 | 146 | NA |
| 37 | 520 | 30 | 560 | 35 | 3 | 23 | 20.5 | 945 | 32 | E |
| 38 | 530 | 30 | 590 | 35 | 2 | 14 | 9.0 | 954 | 42 | NA |
| 39 | 520 | 30 | 560 | 35 | 20 | 0 | 25.8 | 843 | 139 | — |
| 40 | 520 | 30 | 560 | 35 | 10 | 0 | 22.5 | 896 | 122 | NA |
| 41 | 530 | 30 | 590 | 35 | 3 | 18 | 4.8 | 961 | 31 | E |
| 42 | 540 | 30 | 580 | 35 | 5 | 0 | 1.5 | 854 | 145 | — |
| 43 | 530 | 30 | 570 | 35 | 12 | 0 | 67.8 | 1070 | 32 | NA |
| 44 | 520 | 30 | 560 | 35 | 7 | 0 | 13.0 | 955 | 132 | NA |
| 45 | 570 | 45 | — | — | 4 | 0 | 1.5 | 915 | 44 | E |
| 46 | 570 | 45 | — | — | 4 | 0 | 1.8 | 909 | 48 | E |
| 47 | 550 | 30 | 610 | 35 | 6 | 0 | 0.8 | 885 | 44 | E |

[Evaluations Tests]

The steel material (plate material) of each test number produced by the above production method was subjected to a microstructure volume ratio measurement test. a Cu precipitates number density measurement test, a tensile test, a Charpy impact test and a corrosion resistance test.

[Microstructure Volume Ratio Measurement Test]

The steel material of each test number was subjected to a microstructure volume ratio measurement test, and the volume ratios of retained austenite and ferrite were determined. Specifically, for the steel material of each test number, the volume ratio (%) of retained austenite was determined by the above described X-ray diffraction method. The obtained volume ratio (%) of retained austenite of each test number is shown in Table 2 as "Retained γ (%)". In addition, for the steel material of each test number, the volume ratio (%) of ferrite was determined by the aforementioned point counting method in conformity with JIS G 0555 (2003). The obtained volume ratio (%) of ferrite of each test number is shown in Table 2 as "Ferrite (%)"

[Cu Precipitates Number Density Measurement Test]

The steel material of each test number was subjected to a Cu precipitates number density measurement test, and the number density of Cu precipitates was determined. Specifically, first a test specimen having an observation surface with a size of 5 mm in the rolling direction and 5 mm in the plate width direction was prepared from a center portion of the plate thickness of the steel material of each test number. The prepared test specimen was used to determine the number density of Cu precipitates by the method described above. The obtained number density of Cu precipitates (/m$^3$) of each test number is shown in Table 2 as "Cu precipitates number density ($\times 10^{21}$/m$^3$)".

[Tensile Test]

The steel material of each test number was subjected to a tensile test by the above described method in conformity with ASTM E8/ESM (2013), and the yield strength (MPa) was determined. Specifically, first, a round bar specimen for a tensile test was prepared from a center portion of the plate thickness of the steel material of each test number. Note that, the axial direction of the round bar specimen was parallel with the rolling direction of the steel material. The prepared round bar specimen of each test number was subjected to a tensile test in conformity with ASTM E8/E8M (2013). The 0.2% offset proof stress obtained in the tensile test was defined as the yield strength (MPa). The obtained yield strength of each test number is shown in Table 2 as "YS (MPa)".

[Charpy Impact Test]

A Charpy impact test in conformity with ASTM E23 (2018) was performed on the steel material of each test number, and the low-temperature toughness was evaluated. Specifically, first, in conformity with API SCRA (2010), V-notch test specimens for a Charpy impact test were prepared from a center portion of the plate thickness of the steel material of each test number. Three test specimens of each test number that were prepared were cooled to −50° C., and a Charpy impact test in conformity with ASTM E23 (2016) was performed, and the absorbed energy (J) was determined. The arithmetic average value of the determined absorbed energy values was defined as the absorbed energy (J). The obtained absorbed energy (J) of each test number is shown in Table 2 as "E (−50° C.) (J)".

[Corrosion Resistance Test]

The corrosion resistance of steel materials having a yield strength of 125 ksi or more (862 MPa or more) among the steel materials of each test number was evaluated by a method in conformity with NACE TM0177-2016 Method A. Specifically, three round bar specimens were prepared from a center portion of the plate thickness of the steel material of each of the relevant test numbers. In each round bar specimen, the diameter was 6.35 mm, and the length of a parallel portion was 25.4 mm, and the axial direction of the round bar specimen was parallel with the rolling direction of the steel material.

A mixed aqueous solution containing 20 mass % of sodium chloride and 0.41 g/L of sodium acetate to which acetic acid was added to adjust the pH to 4.0 was adopted as the test solution. A stress equivalent to 90% of the actual yield stress was applied to each round bar specimen. The test solution at 24° C. was poured into three test vessels, and these were adopted as test baths. The three round bar specimens to which the stress was applied were immersed individually in mutually different test vessels as the test baths. After each test bath was degassed, $H_2S$ gas at 0.1 atm and $CO_2$ gas at 0.9 atm was blown into the respective test bath to cause the mixed gas to saturate in the test bath. The test baths in which the mixed gas was saturated were held at 24° C. for 720 hours.

After being held for 720 hours, the round bar test specimens were observed with the naked eve, a magnifying glass with a magnification of ×10, and an optical microscope with a magnification of ×100. If cracking was not confirmed in all of the round bar specimens as the result of the observation, the steel material of the relevant test number was evaluated as "E" (Excellent). On the other hand, if cracking was confirmed in at least one of the round bar specimens, the steel material of the relevant test number was evaluated as "NA" (Not Acceptable). Note that, steel materials for which the yield strength was less than 125 ksi (862 MPa) are indicated by "-" (no evaluation). The obtained evaluation results for corrosion resistance of each test number are shown in Table 2.

[Evaluation Results]

Referring to Table 1 and Table 2, for the steel materials of Test Nos. 1 to 34, the chemical compositions were appropriate, and the production method also satisfied the conditions of the preferable production method described above. As a result, in the microstructure, retained austenite was 0 to 15 in vol %, and ferrite was 0 to 10 in vol %. In addition, the number density of Cu precipitates was $3.0\times10^{21}$ to $50.0\times10^{21}/m^3$. Further, the yield strength was 862 MPa or more. In other words, the steel materials of Test Nos. 1 to 34 each had a yield strength of 125 ksi or more. Furthermore, the absorbed energy was 100 J or more, indicating that the steel materials of Test Nos. 1 to 34 each had the excellent low-temperature toughness even in an extremely low-temperature environment. In addition, the evaluation in the corrosion resistance test was "E", indicating that the steel materials of Test Nos. 1 to 34 each had the excellent corrosion resistance.

On the other hand, in the steel material of Test No. 35, the C content was too high. As a result, the evaluation of the corrosion resistance was "NA". In other words, the steel material of Test No. 35 did not have the excellent corrosion resistance.

In the steel material of Test No. 36, the Cr content was too low. As a result, the evaluation of the corrosion resistance was "NA". In other words, the steel material of Test No. 36 did not have the excellent corrosion resistance.

In the steel material of Test No. 37, the Cr content was too high. As a result, the volume ratio of ferrite in the microstructure was too high. Consequently, the absorbed energy was less than 100 J. In other words, the steel material of Test No. 37 did not have the excellent low-temperature toughness.

In the steel material of Test No. 38, the Ni content was too low. As a result, the volume ratio of ferrite in the microstructure was too high. Consequently, the absorbed energy was less than 100 J. In addition, the evaluation of the corrosion resistance was "NA". In other words, the steel material of Test No. 38 had neither the excellent low-temperature toughness nor the excellent corrosion resistance.

In the steel material of Test No. 39, the Ni content was too high. As a result, the volume ratio of retained austenite in the microstructure was too high. Consequently, the yield strength was less than 862 MPa. In other words, the steel material of Test No. 39 did not have a yield strength of 125 ksi or more.

In the steel material of Test No. 40, the Mo content was too low. As a result, the evaluation of the corrosion resistance was "NA". In other words, the steel material of Test No. 40 did not have the excellent corrosion resistance.

In the steel material of Test No. 41, the Mo content was too high. As a result, the volume ratio of ferrite in the microstructure was too high. Consequently, the absorbed energy was less than 100 J. In other words, the steel material of Test No. 41 did not have the excellent low-temperature toughness.

In the steel material of Test No. 42, the Cu content was too low. As a result, the number density of Cu precipitates was less than $3.0\times10^{21}/m^3$. Consequently, the yield strength was less than 862 MPa. In other words, the steel material of Test No. 42 did not have a yield strength of 125 ksi or more.

In the steel material of Test No. 43, the Cu content was too high. As a result, the number density of Cu precipitates was more than $50.0\times10^{21}/m^3$. Consequently, the absorbed energy was less than 100 J. In addition, the evaluation of the corrosion resistance was "NA". In other words, the steel material of Test No. 43 had neither the excellent low-temperature toughness nor the excellent corrosion resistance.

In the steel material of Test No. 44, the Co content was too low. As a result, the evaluation of the corrosion resistance was "NA". In other words, the steel material of Test No. 44 did not have the excellent corrosion resistance.

In the production process for the steel materials of Test Nos. 45 and 46, the tempering temperature TI in the first tempering process was too high. Furthermore, the second tempering process was not performed. As a result, the number density of Cu precipitates was less than $3.0\times10^{21}/m^3$. Consequently, the absorbed energy was less than 100 J. In other words, the steel materials of Test Nos. 45 and 46 did not have the excellent low-temperature toughness.

In the production process for the steel material of Test No. 47, the tempering temperature TI in the first tempering process was too high. As a result, the number density of Cu precipitates was less than $3.0\times10^{21}/m^3$. Consequently, the absorbed energy was less than 100 J. In other words, the steel material of Test No. 47 did not have the excellent low-temperature toughness.

An embodiment of the present disclosure has been described above. However, the embodiment described above is merely an example for carrying out the present disclosure. Therefore, the present disclosure is not limited to the above-described embodiment, and can be carried out by appropriately modifying the above-described embodiment within a range not departing from the spirit thereof.

The invention claimed is:

1. A martensitic stainless steel material, consisting of, in mass %,

C: less than 0.030%,
Si: 1.00% or less,
Mn: 0.05 to 2.00%,
P: 0.050% or less,
S: 0.0050% or less,
Cr: 11.50 to 14.00%,
Ni: 5.00 to 7.50%,
Mo: 1.10 to 3.50%,
Cu: 0.50 to 3.50%,
Co: 0.01 to 0.30%,
Al: 0.001 to 0.100%,
N: 0.001 to 0.100%, O: 0.010% or less,
W: 0 to 2.00%,
V: 0 to 0.300%,
Ti: 0 to 0.300%,
Nb: 0 to 0.300%,
Ca: 0 to 0.0100%,
Mg: 0 to 0.0100%,
rare earth metal: 0 to 0.100%,
B: 0 to 0.0100%, and
the balance: Fe and impurities,
wherein:
a microstructure is composed of, in vol %, retained austenite in an amount of 0 to 15%, and ferrite in an amount of 0 to 10%, with the balance being martensite;
a yield strength is 862 MPa or more; and
in the steel material, a number density of Cu precipitates is $3.0\times10^{21}$ to $50.0\times10^{21}/m^3$.

2. The martensitic stainless steel material according to claim 1, wherein one or more elements is selected from the group consisting of:
W: 0.01 to 2.00%, V: 0.001 to 0.300%, Ti: 0.001 to 0.300%, Nb: 0.001 to 0.300%, Ca: 0.0010 to 0.0100%, Mg: 0.0010 to 0.0100%, rare earth metal: 0.001 to 0.100%, and B: 0.0001 to 0.0100%.

* * * * *